United States Patent [19]

Shoenhair et al.

[11] Patent Number: 4,779,384

[45] Date of Patent: Oct. 25, 1988

[54] RAIL GRINDER

[75] Inventors: John J. Shoenhair; Darrell E. Johnson; Richard J. Gitter; Bernard C. Lancette; Winfred C. Croft, all of Fairmont, Minn.

[73] Assignee: Harsco Corporation, Camp Hill, Pa.

[21] Appl. No.: 828,984

[22] Filed: Feb. 13, 1986

[51] Int. Cl.[4] ..... B24B 23/00

[52] U.S. Cl. ..... 51/178; 364/474.06

[58] Field of Search ..... 51/178; 364/474

[56] References Cited

U.S. PATENT DOCUMENTS

| | | | |
|---|---|---|---|
| 2,459,902 | 1/1949 | Tucker . | |
| 2,779,141 | 1/1957 | Speno et al. . | |
| 3,358,406 | 12/1967 | Speno et al. . | |
| 3,394,501 | 7/1968 | Carlson et al. . | |
| 3,524,285 | 8/1970 | Rutt . | |
| 3,526,997 | 9/1970 | Panetti . | |
| 3,606,705 | 9/1971 | Rivoire . | |
| 3,707,808 | 1/1973 | Danko et al. . | |
| 3,877,180 | 4/1975 | Brecker . | |
| 3,888,052 | 6/1975 | Panetti . | |
| 3,918,215 | 11/1975 | Scheuchzer . | |
| 4,020,599 | 5/1977 | Panetti . | |
| 4,050,196 | 9/1977 | Theurer . | |
| 4,091,578 | 5/1978 | Panetti . | |
| 4,115,857 | 9/1978 | Panetti | 51/178 |
| 4,135,578 | 1/1979 | Theurer . | |
| 4,178,724 | 12/1979 | Bruno . | |
| 4,189,873 | 2/1980 | Panetti . | |
| 4,205,494 | 6/1980 | Rivoire . | |
| 4,347,688 | 9/1982 | Scheuchzer et al. . | |
| 4,490,947 | 1/1985 | Theurer et al. . | |
| 4,492,059 | 1/1985 | Panetti . | |
| 4,583,327 | 4/1986 | Jaeggi . | |
| 4,584,798 | 4/1986 | Rivoire | 51/178 |
| 4,596,092 | 6/1986 | Panetti . | |

FOREIGN PATENT DOCUMENTS

| | | |
|---|---|---|
| 867098 | 4/1951 | Fed. Rep. of Germany . |
| 869608 | 6/1951 | Fed. Rep. of Germany . |

OTHER PUBLICATIONS

MOOG Technical Bulletin 146, T. Peter Neal, Oct. 1980, Moog, Inc. Controls Group, pp. 1-6.

Sundstrand Mobile Controls, bulletin 95-8955-4, Aug., 1983, pp. 1-9.

*Primary Examiner*—Roscoe V. Parker

*Attorney, Agent, or Firm*—Kerkam, Stowell, Kondracki & Clarke

[57] ABSTRACT

A rail grinder vehicle includes a series of connections between grinders and a chassis frame such that pairs of the grinders may be operated in an independent mode allowing separate movement and in wave control mode wherein the pair of grinders are coupled together for movement in unison. The grinders are supported from a K frame which is pivotably mounted at the center of the vehicle for stability. Each grinder is mounted upon a grinder support element and associated structure such that the grind stone of the grinder may be positioned relative to the rail and will automatically and simultaneously orient the grinding face of the grind stone at a proper angle relative to the rail corresponding to the desired position. A control system including a hydraulic system which is controlled by an electrical system is used to operate the grinders and maintain the individual grind motors at a constant power during grinding in an independent mode. The control system includes a feedback loop and is operable in a wave control mode to automatically select a torque signal representative of the motor operating at the highest power as the input signal to the feedback loop.

43 Claims, 18 Drawing Sheets

FIG. 7
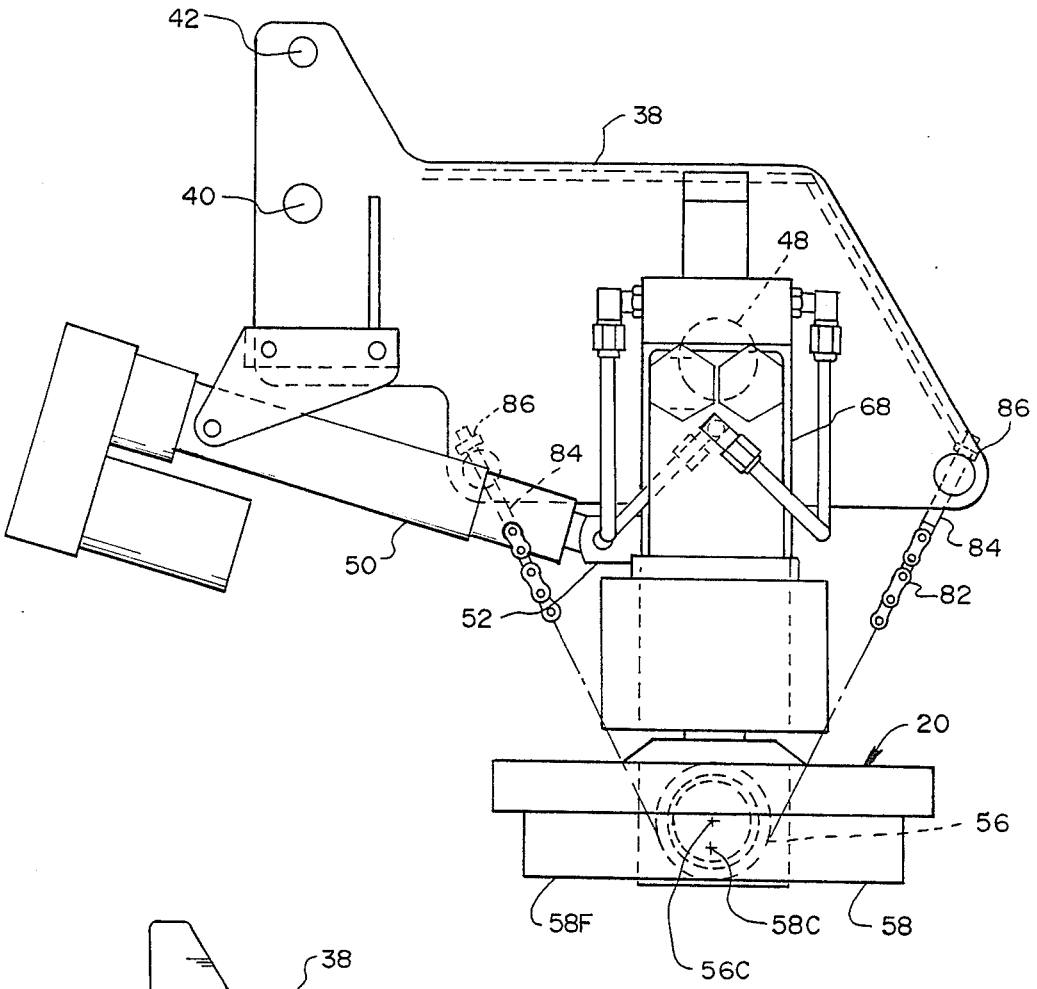
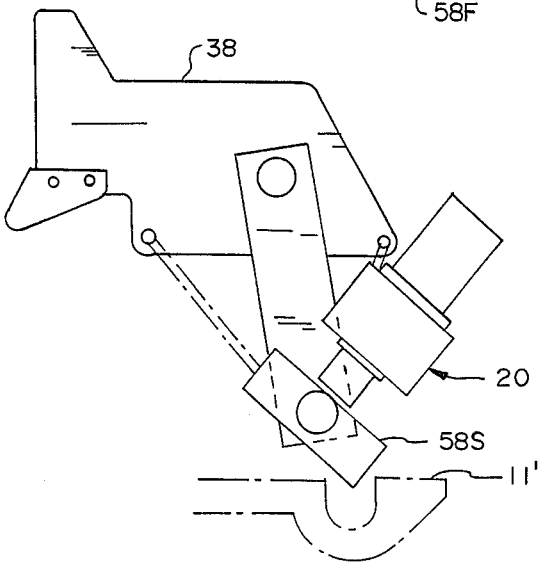
FIG. 10A

FIG. 8
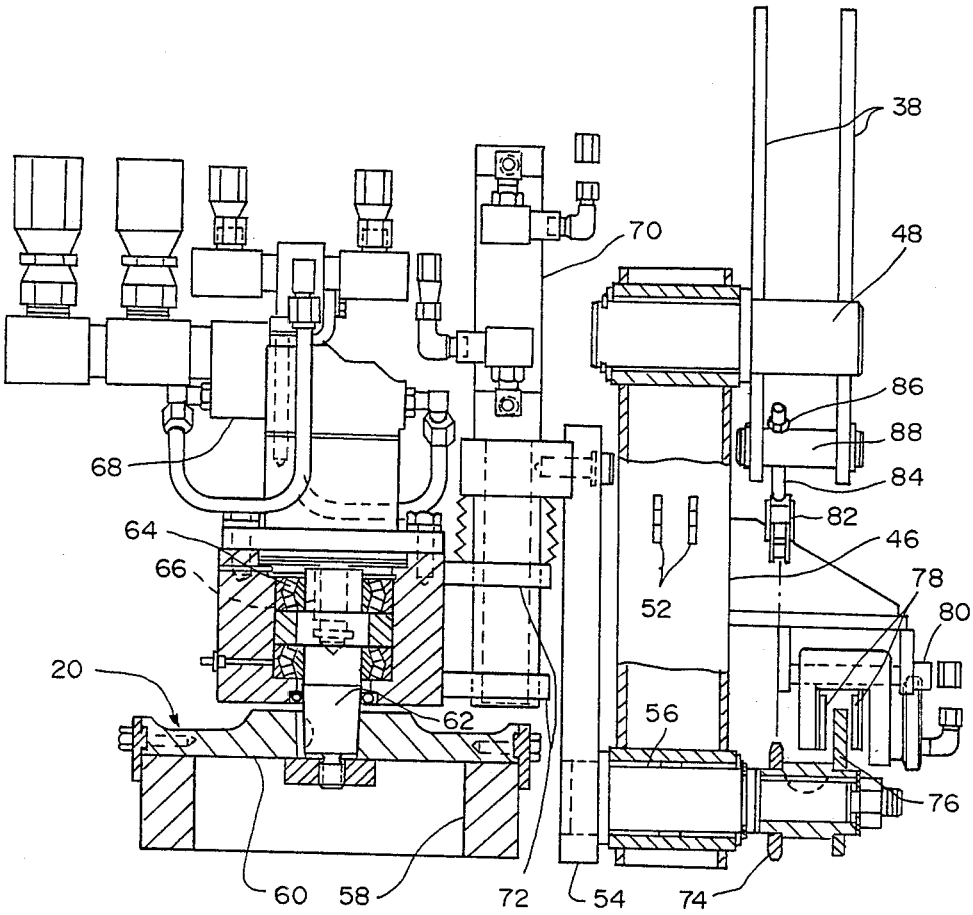
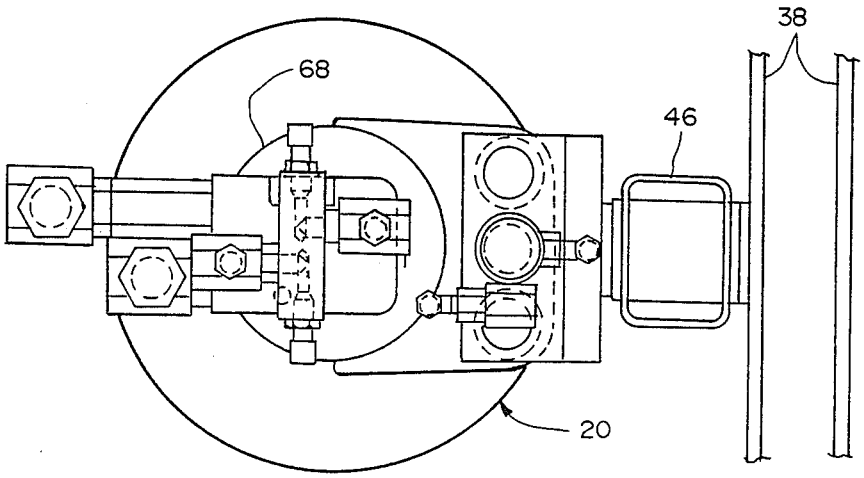
FIG. 9

138

RAIL GRINDER

BACKGROUND OF THE INVENTION

The present invention relates to a rail grinder.

The use of rail grinders for grinding irregularities in a rail of an existing railroad track is well known. In particular such rail grinders may be vehicles which move along a track and include a plurality of grind stones which grind the rail. The grinder vehicle may include a large number of grinding stones which are set at different angles in order to profile or reshape the cross-section of a rail. Certain kinds of rail grinders have heretofor been used to smooth out waves which are formed in a rail due to the repeated passage of trains over the rail.

As used herein, "grind stone" shall refer to the grinding element, regardless of its composition, which contacts a rail or other work piece for grinding thereupon. A grind stone is sometimes called a grind wheel.

As used herein, a "railroad track" shall include any track having a rail that constitutes a road pathway for a vehicle.

Existing rail grinder arrangements have been generally subject to one or more of several disadvantages. In particular, they have had difficulty smoothing out the waves in the track when the waves are longer than the diameter of the grind stone. That is, the grind stone may grind down into the dips into the rail instead of simply grinding off the peaks in the wave on the rail. Although larger grind stones may help with this problem, power and other constrants prevent one from using an especially large grind stone.

Prior grinders often have an additional disadvantage in that many of them require the use of "feelers" in order to allow the grinding wheel to follow the track at curves such that chordal error is minimized. Such feelers may be small rollers which support the grinding stones in an isolated fashion from the main suspension of the vehicle. On the other hand, those grinders which are mounted from the main suspension of a vehicle and near the vehicle wheels are disadvantageous in that the grinders are not isolated from the suspension such that up and down movement of the suspension may cause the grinder to amplify (by further grinding) waves which are already existing in the rail.

A further disadvantage of numerous of the prior grinder vehicles and, more generally, various grinder machines, is that there is a lack of flexibililty in setting up the angle of grinding. That is, the range of angles over which the grinder may be set is often quite limited. Changing the angle of grinding often changes the distance to the rail. Moreover, setting of the angle of the grinder may require the unbolting and bolting of different components, this being a rather time consuming step. Further, setting of the angle and positioning of the grinder in the correct position relative to the rail may require separate steps and often requires the operator to leave the vehicle cab. Setting the vertical position of a grinder often requires a separate step from setting its horizontal position.

Another disadvantage of some prior grinders is that the grinding power delivered to the rail may be quite inconsistent.

Some prior grinders require precision machine surfaces adversely affected by the environment.

Those prior grinders which allow some grinder orientation changes by operator control from a vehicle cab often are limited to specific angles of grinding.

A further disadvantage of numerous prior grinders is that those that allow grinding for wave control often are not suitable for profiling, whereas those which are adapted for profiling are generally not well suited for smoothing out the waves in the rail.

Another disadvantage common to numerous prior grinders is that they are not suitable for use at crossings, switches, turnouts, and on specially shaped rails or specially laid rails such as used where a track crosses a road or crosses another track.

Those prior grinders which allow adjustment of grinder angle and/or position are often disadvantageous in that they may assume improper positions such as having the grind stone beneath the ball of the rail. On the other hand, use of feed stops to help avoid having a feed jack move to such a position may complicate the design as the feed stops generally must be adjustable.

OBJECTS AND SUMMARY OF THE INVENTION

It is a primary object of the present invention to provide a new and improved grinding apparatus, more specifically a rail grinding vehicle.

A further object of the present invention is to overcome or minimize those disadvantages of prior grinders as discussed above.

Other objects of the present invention will become more apparent as the description proceeds.

The present invention is realized by a rail grinder vehicle having a front, back, and two sides and comprising: a chassis having wheels for movement along a railroad track; a grinder assembly mounting frame movably mounted to the chassis; first and second grinder support members mounted to the grinder assembly mounting frame; first and second grinders respectively mounted to the first and second grinder support members, each grinder having a grind stone, a motor for rotating the grind stone, and a hydraulic feed jack operable for moving the grind stone against and away from a rail, and both grinders operable for grinding a common rail; a hydraulic wave control jack attached to the chassis and operable to move the grinder assembly mounting frame relative to the chassis and, in turn, to move the first and second grinders; a hydraulic system for controlling the position of the grind stones relative to a rail; and a mode controller connected to the hydraulic system and operable during grinding in an independent mode to apply the grind stones against the rail by causing the hydraulic system to separately control the feed jacks of the first and second grinders while maintaining the feed jack in a steady state, and operable during grinding in a wave mode to apply the grind stones against a rail by causing the hydraulic system to control the wave control jack while maintaining the feed jacks in a steady state, the wave mode linking the grind stones together for movement in unison and with the feed jacks at a common stroke length for smoothing out waves in rail. The control jack and feed jack could alternately be electric or pneumatic in which case a non-hydraulic control system might be used in place of the hydraulic system. The hydraulic system may include two grind feed lines and a mode valve means. In the independent mode, the mode controller causes the mode valve means to allow application of hydraulic fluid to the feed jacks. In the wave control mode, the mode controller causes the mode valve means to allow application of hydraulic fluid to the wave control jack. The hydraulic system is part of a control system and the control system may operate in both the wave mode and the independent mode to maintain a constant grinding power on a rail. The control system further includes an electrical system, the electrical system controlling the wave control jack and the feed jacks. The electrical system includes a first feedback loop operable in the independent mode to maintain application of the grind stone of the first grinder against a rail at a constant grinding power, and wherein the first feedback loop is operable in the wave mode to maintain application of both of the grind stones at a given constant total grinding power with the distribution of grinding power varying between grind stones. Alternately, the first feedback loop is operable during grinding in the wave mode to control said control jack such that:

> the sum of the power of the motors of the grinders automatically varies over time depending on surface variations of the rail which is being ground; the power of each motor automatically varies over time depending on surface variations of the rail which is being ground; and at any given time, at least one motor is at a predetermined power and an other motor is at no greater than the predetermined power.

The grinder assembly mounting frame is pivotably attached to the chassis by a pivot axis extending longitudinally along the rail grinder vehicle, the pivot axis being transversly (tranverse to rail longitudinal direction) spaced from the grind stones by at least 40% of the distance from an adjacent side of the vehicle to a remote side of the vehicle. The pivot axis extends centrally along the vehicle. The first and second grinder support members are separately movably mounted to the grinder assembly mounting frame. The invention further comprises first and second grind stone positioners, each positioner operable to simultaneously change the position (both vertically and horizontally) and angle of a corresponding one of the grind stones relative to a rail such that, for any given angle over a range of angles, the one of the grind stones is in proper position for the feed jack to apply the grind stone against the rail. The invention further comprises a first transducer outputting an electrical torque signal as a function of the torque of the motor of the first grinder and a control system receiving the torque signal and operable to control the feedback of the first grinder for moving the grind stone of the first grinder, the control system operable to maintain a constant power in the motor.

The invention may alternately be described as a rail grinder vehicle comprising: a chassis having wheels for movement along a railroad track; a grinder assembly mounting frame movably mounted to the chassis and including a beam extending lengthwise along the vehicle; first and second grinder support members separately and pivotably mounted to the grinder assembly mounting frame; first and second grinders operable for grinding on a rail common thereto and upon which an adjacent pair of the wheels are supported; a control system for controlling the position of the grind stones relative to the rail; and wherein the grinder assembly mounting frame is pivotably attached to the chassis by a pivot axis extending longitudinally along the rail grinder vehicle, the pivot axis being transversely spaced from an adjacent side of the vehicle by at least 40% of the distance to a remote side of the vehicle. A control jack is attached to the chassis and operable to move the grinder assembly mounting frame relative to the chassis. First and second links are separately, pivotably connected in a common axis to the chassis above and vertically in line with the pivot axis for movement in parallel to the grinder assembly mounting frame, the first and second links maintaining the first and second grinder support members in the same orientation independent of the control jack. First and second pivot members are pivotably attached to a corresponding one of the first and second grinder support members and pivotably attached to a corresponding one of the first and second positioners. Each of the first and second grinders is mounted to a corresponding one of the first and second grinder support members by way of a corresponding one of the first and second pivot members. The beam extends to opposite sides of one of the wheels and each of the first and second grinder support members is mounted on opposite sides of the one of the wheels.

The present invention may alternately be described as a rail grinder vehicle comprising: a chassis having wheels for movement along a railroad track; a first grinder support member supported by the chassis; a first grinder mounted to the first grinder support member, the first grinder having a grind stone, a motor for rotating the grind stone, and a feed jack operable for moving the grind stone against and away from a rail; and a first grind stone positioner operable to simultaneously change the position (both horizontally and vertically) and angle of the grind stone relative to a rail such that, for any given angle of the grind stone over a range of angles, the grind stone is in proper position for the feed jack to apply it against the rail. Upon the positioner moving the grind stone from any one angle to any other angle, operation of the positioner is sufficient (i.e., adjustment of feed stops or other mechanisms is not required) to maintain the grind stone at a proper position as to allow the feed jack to apply the grind stone against the rail. The positioner is controlled by an angle controller mounted in a cab on the vehicle and allows the angle to be set at any angle (i.e., not limited to discrete values) over a range of at least 180°. The positioner is operable with the feed jack retracted to vary the angle over the range while maintaining the distance from the grind stone to the rail uniform within ±20% of a given value. A first pivot member is pivotably attached at an upper pivot point to the first grinder support member, the first positioner is operable to pivot the first pivot member, and the first grinder is mounted to the first grinder support member by way of the pivot member. A first arm is pivotably mounted to the first pivot member at a lower pivot point spaced from the upper pivot point and the first grinder is mounted to the first arm. The first positioner is pivotably attached to the first pivot member. The invention further comprises an orientation means to automatically pivot the first arm and the first grinder about the lower pivot point when the first positioner pivots the first pivot member. The invention further comprises a shaft mounted at the lower pivot point and a sprocket mounted to the shaft, and the shaft is fixed to the first arm. The orientation means is a chain meshed to the sprocket and attached to the first grinder support member. The invention further comprises a brake operable to secure the first arm in a given position.

The invention may alternately be described as a rail grinder vehicle comprising: a chassis having wheels for movement along a railroad track; a first grinder support member supported by the chassis; a first grinder mounted to the first grinder support member, the first grinder having a first grind stone, a first motor for rotating the grind stone, and a first feed jack operable for moving the grind stone against and away from a rail; a first transducer outputting an electrical torque signal as a function of the torque of the first motor; and a control system receiving the torque signal and operable to control the first feed jack for moving the first grind stone, the control system further operable to maintain a constant grinding power on a rail. The invention further comprises a second grinder support member and second grinder constructed and operable in like fashion respectively to the first grinder support member and the first grinder, a grinder assembly frame movably mounted to the chassis, and wherein both of the grinder support members are mounted to the grinder assembly mounting frame, and the control system includes a hydraulic system for controlling the position of the grind stones relative to a rail.

BRIEF DESCRIPTION OF THE DRAWINGS

The above and other features of the present invention will be more readily understood when the following detailed description is considered in conjunction with the accompanying drawings wherein like characters represent like parts throughout the several views and in which:

FIG. 7 shows a front view of a grinder head assembly used with the present invention.

FIG. 8 shows a side view with parts in cross-section of the grinder head assembly arrangement of FIG. 7.

FIG. 9 shows a top view of the grinder head assembly.

FIG. 10A shows a simplified front view illustrating how a small grind stone may be used to grind a special rail.

DETAILED DESCRIPTION

Figure 1:
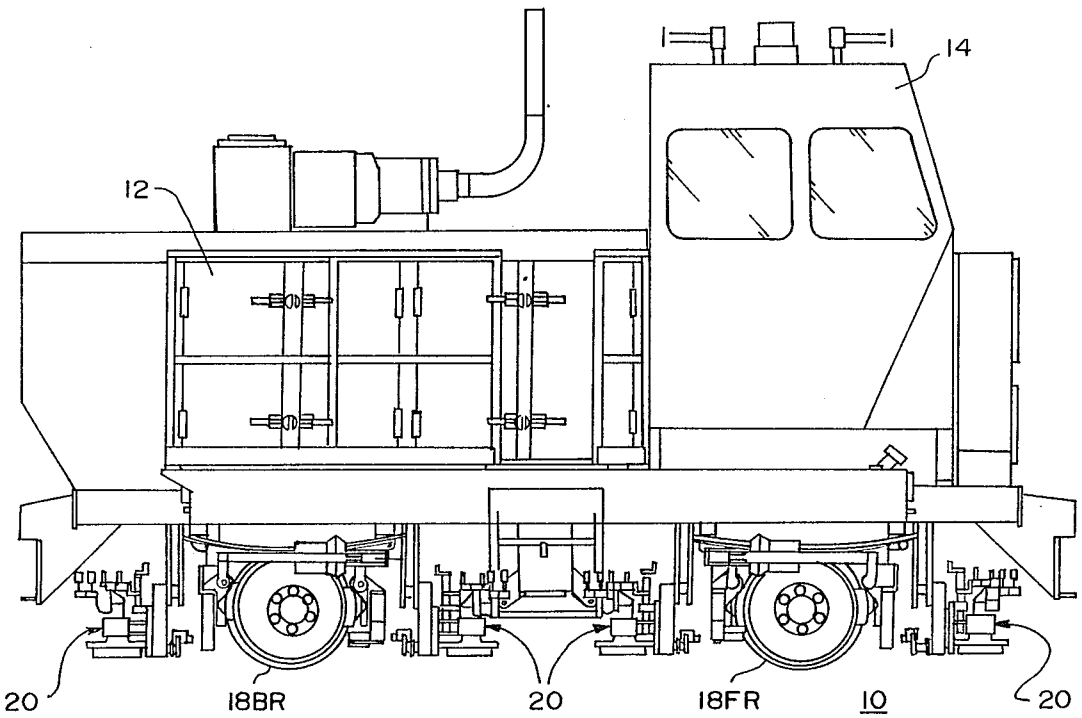
FIG. 1 shows a side view of the vehicle of the present invention.
Figure 3:
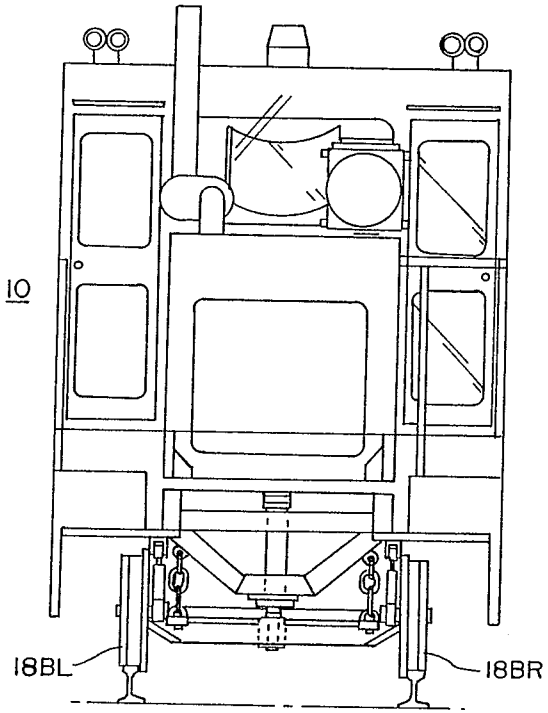
FIG. 3 shows a rear view of the vehicle.
Figure 2:
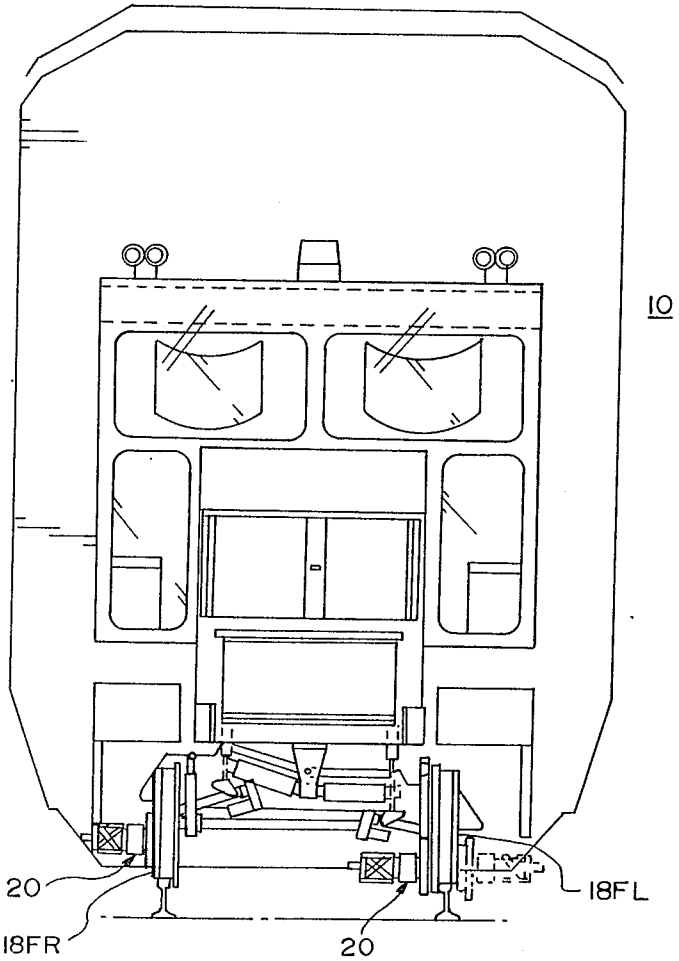
FIG. 2 shows a front view of the vehicle of FIG. 1.
Figure 4:
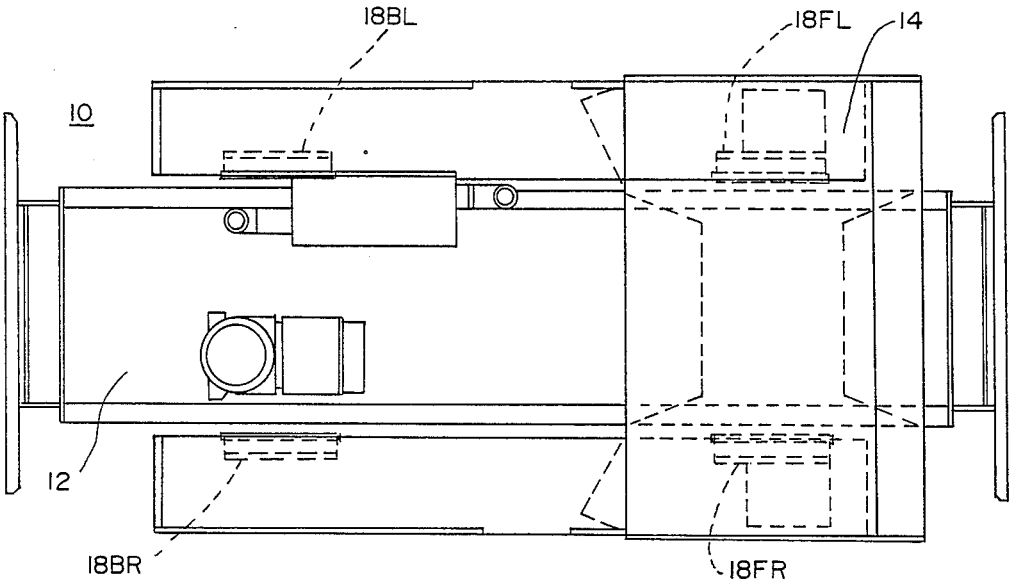
FIG. 4 shows a top view of the vehicle.

With reference now to the side view of FIG. 1, the front view of FIG. 2, the back view of FIG. 3 and the top view of FIG. 4, the overall vehicle 10 of the present invention will be discussed. The vehicle 10 is a self-propelled vehicle having a turbo diesel engine, pump drive, and hydraulic pump within compartment 12. As shown, a muffler is mounted on top of compartment 12 and a cab 14 is disposed at the front of the vehicle 10. A guard (not shown in drawings) is used to contain sparks and debris resulting from the operation of grinders upon the rail. These and other features are only briefly discussed as they are not central to the present invention.

The vehicle 10 rolls along four wheels 18FL, 18FR, 18BL and 18BR. Four grinders 20 are mounted upon each side of the vehicle 10. With reference to FIG. 1, the grinder 20 in front of wheel 18FR and the grinder 20 immediately behind wheel 18FR will be mounted upon a common grinder assembly mounting frame discussed in detail below. As the mounting of the grinders 20 is symmetrical with respect to a central axis extending lengthwise in between the rails, and considering that the grinders 20 adjacent the rear wheels are mounted the same fashion as the grinders 20 adjacent the front wheels, the discussion below will generally not distinguish between such grinders.

Figure 5:
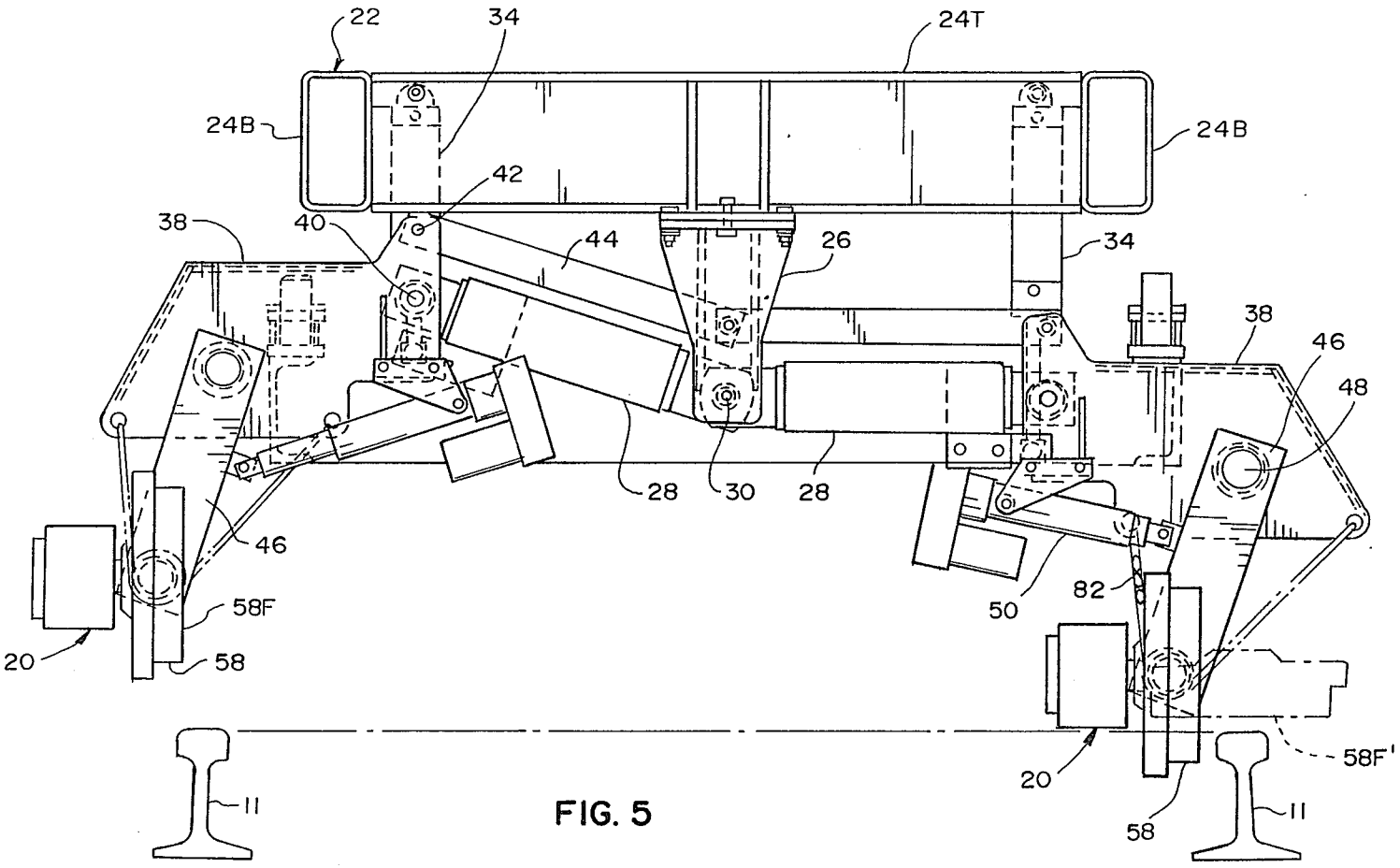
FIG. 5 shows a simplified front view of a grinder mounting arrangement used with the present invention.

FIG. 5 shows a simplified front view of part of the vehicle and illustrating how grinders 20 are mounted thereupon. The main frame 22 which is part of the vehicle chassis of the vehicle 10 includes two longitudinal extending beams 24B with four transverse beams 24T extending there between. (Only one of the transverse beams 24T is visible in FIG. 5, it being readily understood that the other transverse beams are constructed in identical fashion and that the main frame 22 includes four such transverse beams corresponding to the four grinders on each side of the vehicle.) A mounting piece 26 extends downwardly from the transverse beam 24T upon which it is fixed. The mounting piece 26 may include two parallel plate portions between which a plurality of components may be pivotably attached. In particular, a grinder assembly mounting frame 28 is pivotably attached to the mounting piece 26 at a pivot axis 30. As the structure to the right and left of pivot axis 30 is symmetric about a vertical plane, only the left side of the pivot axis 30 will be discussed except where otherwise noted.

Figure 6:
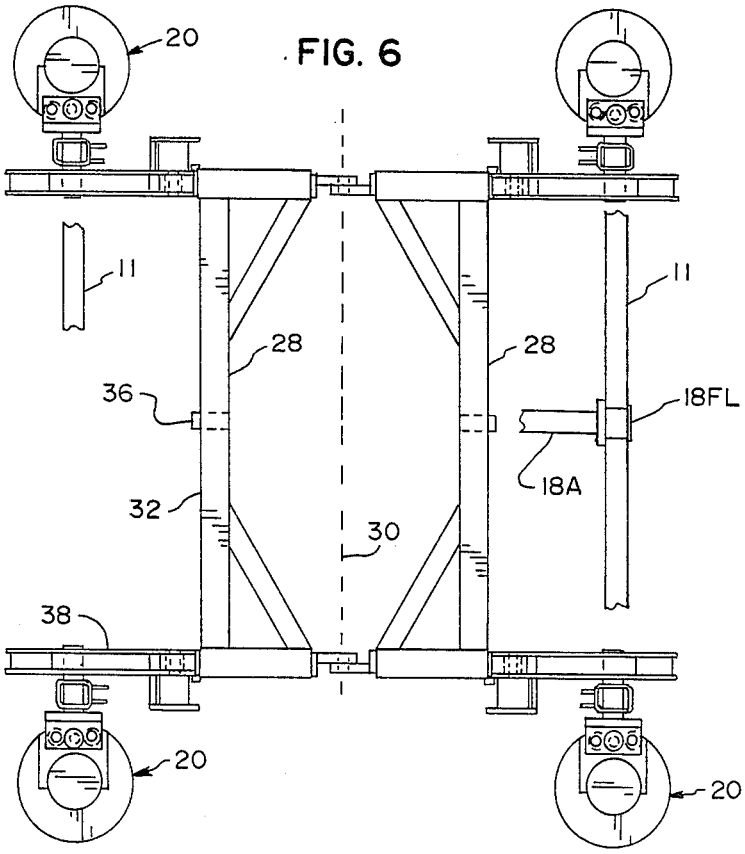
FIG. 6 shows a simplified top view of the grinder mounting arrangement.

Continuing to consider the view of FIG. 5, reference should also be made to the simplified top view of FIG. 6 which illustrates two of the grinder assembly mounting frames 28 and parts which are mounted thereon. Each grinder assembly mounting frame 28 is shaped like a K and, for simplicity, will called a "K frame" as the description proceeds, it being understood that the invention is not limited to such a shape. The vehicle would include two front K frames and two back K frames.

Each K frame includes a lengthwise extending beam 32 which extends to opposite sides of a particular wheel (only wheel 18FL, a portion of an axle 18A, and parts of the rails 11 are shown in FIG. 6) such that two grinders 20 supported at opposite ends of the K frame may be disposed on opposite sides of an adjacent wheel. In other words, the grinders 20 supported by a particular K frame 28 are symmetrically arranged with respect to a vehicle wheel disposed an equal distance between the grinders 20.

A wave control jack, more specifically a hydraulic wave control cylinder 34, is pivotably fixed at an inwardly extending flange from beam 24B and extends downwardly for pivotable connection (about a longitudinally pivoting axis) to a piece 36 (FIG. 6 only) of the beam 32. Mounted upon each end of the K frame 28 is a grinder support member 38. In addition to being pivotably connected to the K frame 28 at pivot point 40, each member 38 is pivotably connected at pivot point 42 to a link 44 extending to a pivotal connection with corresponding mounting piece 26 such that the link 44, mounting piece 26, K frame 28, and member 38 together form a "four-bar linkage" with the upper link 44 moving in parallel fashion to the K frame 28 such that the member 38 maintains a proper orientation (i.e., is not appreciably rotated) when the wave control cylinder 34 raises or lowers the K frame 28, thereby raising or lowering the members 38 mounted thereon. There is one link 44 for each member 38 and, accordingly, two links 44 for each K frame 28.

Continuing to view FIG. 5, but also considering the detailed front view of grinder 20 and its support member 38 of FIG. 7, the side view of grinder 20 and member 38 with parts in cross-section of FIG. 8, and the top view of the grinder 20 and member 38 as shown in FIG. 9, the specifics of the mounting of the grinders 20 will be discussed in detail. It should initially be noted that some parts of the grinder 20 are not shown in FIG. 5 for simplicity. The grinder support member 38 may be comprised of two parallel plates bolted or otherwise fixed together such that the K frame 28 and one of the links 44 may be pivotably connected between the two parallel plates.

A pivot member or support tube 46 is pivotably mounted from the member 38 at an upper pivot point corresponding to shaft 48. A grind stone positioner 50 is pivotably mounted to a flange fixed to the member 38. The positioner 50, which is preferably an electric ball screw actuator, is also pivotably connected to flanges 52. An arm 54 is pivotably mounted to the pivot member or support tube 46 at a lower pivot point corresponding to the axis of shaft 56, which shaft is fixed to arm 54 for rotation therewith.

The grinder 20 includes a grind stone 58, chuck 60, stub shaft 62, bearings 64, motor shaft 66 keyed into the stub shaft 62, hydraulic motor 68 which powers the motor shaft 66, and feed jack 70. The feed jack 70, preferably a double-acting hydraulic cylinder, is fixed to the upper end of the arm 54 such that the grinder rotation axis (vertical in FIG. 8) is parallel to the grinder head arm 54. The feed jack 70 moves the grind stone 58 toward and away from a rail by way of the mounting pieces 72.

As will be clearly appreciated from FIG. 8, the arrangement provides that the stroke direction (i.e., direction of stroke movement caused by activation) of the hydraulic feed jack or cylinder 70 is always parallel to an axis of rotation of the grind motor 68. The axis of rotation will be readily appreciated from the above description to be along the motor shaft 66. It will also be appreciated that the grind stone 58 is the only grind stone which is movable by operation of the particular feed jack 70 shown in FIG. 8.

Mounted upon the shaft 56 is a sprocket 74 and a brake member 76 which is positioned such that it may be gripped between brake pads 78 of a hydraulic brake 80 mounted to the pivot member or support tube 46.

A chain 82 is meshed into the sprocket 74 and serves as an orientation means to properly orient the angle of the grind stone 58 depending upon the position (i.e., as set by horizontal and/or vertical translational movement) of the grind stone 58 relative to the rail. That is, the chain 74 will usually (rail cant adjustment discussed below allows sight deviations when desired) orient the grind stone 58 to a 9° gauge angle when the electric actuator or positioner 50 positions the support tube 46 at its furthest position on the gauge side of a rail (see especially right side of FIG. 5). As the grind stone positioner 50 extends in length to pivot the support tube or pivot member 46 about its shaft 48, the chain 82 will turn the sprocket 74, thereby rotating shaft 56 and pivoting the grinder 20 and its arm 54 about a lower pivot point or axis corresponding to the center of shaft 56. When the support tube or pivot member 46 has been moved to its furthest position on the field side, the grind stone 58 will have rotated its grinding face 58F 180° (see left side grinder 20 of FIG. 5) such that it is now in position for application to the field side of the rail 11. When the support tube 46 is midway between its fieldmost and its gaugemost positions, the grind stone face 58F would ordinarily be horizontally disposed as shown in phantom line labeled, 58F' on the right side of FIG. 5.

The chain 82 has a threaded rod 84 (see especially FIG. 7 and 8) mounted at each end thereof and having adjustable nuts 86 for adjusting the tension of the chain 82 each end of which is secured to a pin 88 extending between two parallel plates of member 38. Further, the threaded rods 84 and nuts 86 serve as a rail cant adjustment mechanism. If the grinder is to be used on rail which is canted (i.e., banked) the nuts 86 can be set such that the grind stone angle can be changed without changing the position of the grind stone. For example, if the rail is canted 4° from horizontal to the gauge side (left in FIG. 7), the right side nut 86 of FIG. 7 may be loosened and the left side nut 86 may be tightened to take up the slack until the chain 82 has rotated grind stone face 58F to be at 4° to the gauge side with pivot member 46 of FIG. 8 vertically disposed. Feed jack 70 and support arm 54, both of which extend lengthwise perpendicularly to the surface of face 58F, would be leaning at 4° from vertical in the gauge direction. The positioner 50 may then be used to automatically and simultaneously set the position an angle of the grind stone as before except that the cant adjustment mechanism has supplied an offset to the angle to compensate for the rail cant. Since an angle measurement meter, discussed below, depends upon the setting on positioner 50, the meter will advantageously reflect the angle of the grind stone relative to the rail as opposed to the angle relative to the horizon. The nuts 86 and rods 84 will preferably allow adjustment for 4° rail cant in both field and gauge directions. If desired, a spring or springs could be used to maintain tension in the chain 82.

With special reference to FIGS. 5, 6, and 8, it will be appreciated that two grinders 20 are mounted to each of the grinder assembly mounting frames or K frames 28. Each grinder 20 is mounted to the K frame by way an arm 54, pivot member 46, and grinder support member 38, the grinder support member 38 in turn being pivotably mounted upon the K frame 28. The K frame 28 is in turn pivotably mounted upon the main frame or chassis 22 by way of the flange 26.

As shown in the simplified front view of FIG. 10A, the present invention may be used for grinding various types of specially shaped rail such as the rail 11 prime.

In particular, the grinder 20 may have the chuck 60 (refer back to FIG. 8) removed by way of the nut disposed at the end of the stub shaft 62 such that a different chuck and different size grind stone 58S may be place upon the grinder 20.

Figure 10B:
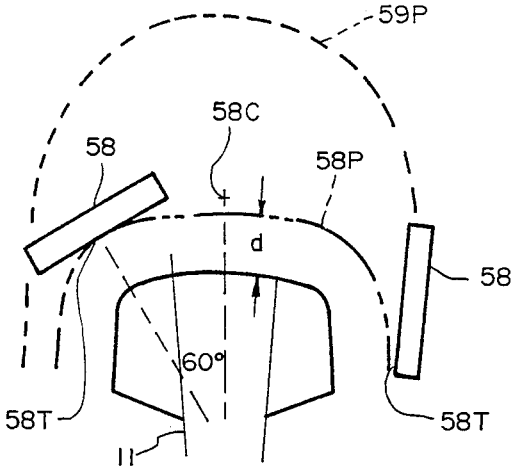
FIGS. 10B and 10C show the path traversed by the grind stone of the present invention and, for comparison purposes, an alternate arrangement path in FIG. 10B.

FIG. 10B shows a simplified view illustrating the path 58P of the face of grind stone 58, which grind stone is shown in at a 6° left side position and a 9° right side position. The present invention advantageously provides that the distance d from the grind stone face (with the feed cylinder 70 retracted) to rail 11 is relatively uniform (preferably within 20%) at least for 132 lb. rail over the 180° range. As shown by the left positioned grind stone 58, the present design maintains the grind stone portion which contacts the rail approximately at point 58T over at least 120° of the range to minimize side loading. The relative uniformity of distance d is advantageous in avoiding excess feed space and/or the need for feed stop adjustments which might be otherwise required. For example, an alternate path 59P which might be composed of a semicircular portion about 59C with vertical side portions would have excess feed space (requiring a longer stroke feed jack) at the top of its path than at its sides. Advantageously, the grind stone 58 of the present invention will be kept above the rail head.

Figure 10C:
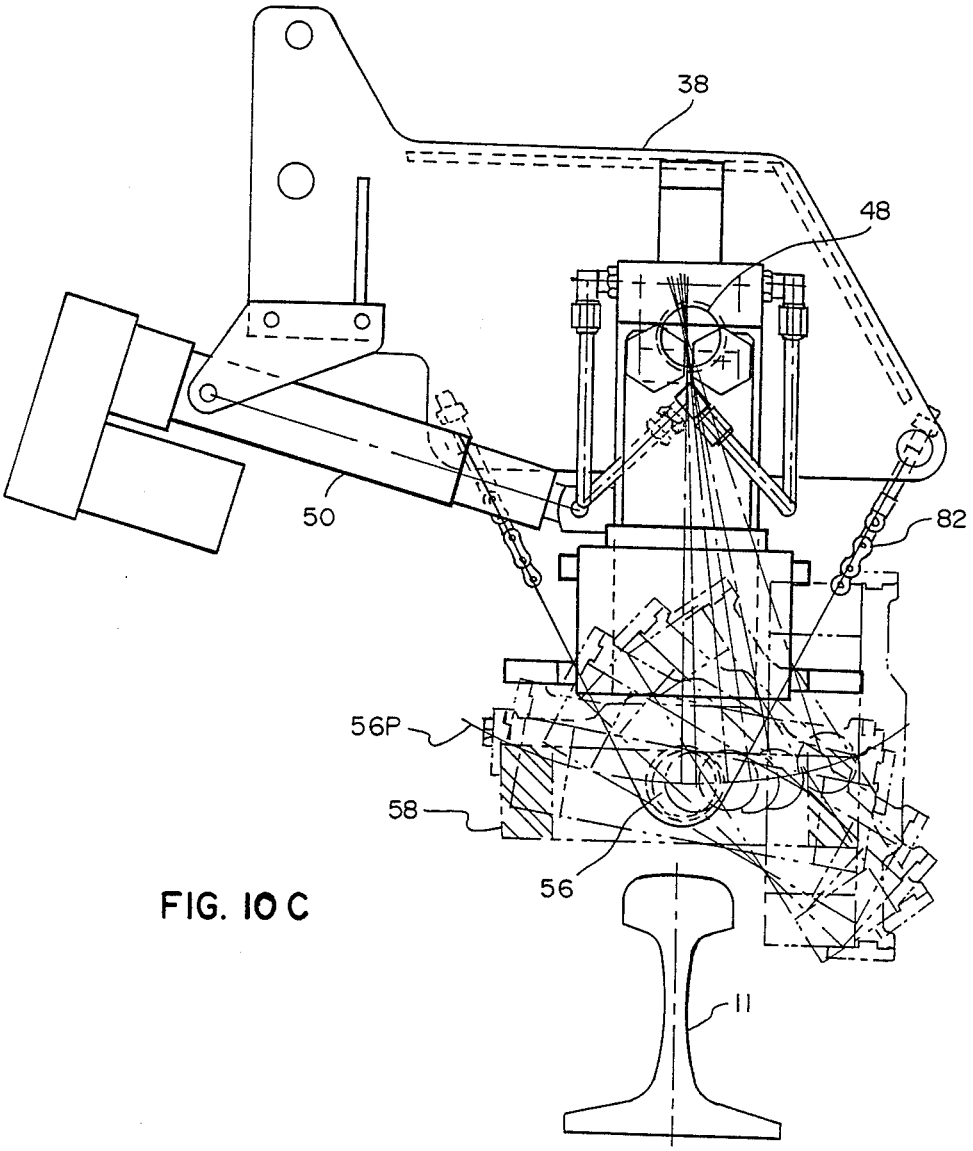

FIG. 10C shows that the path 56P of the lower pivot point or axis of shaft 56 will follow a circular curve centered about the upper pivot point or axis of shaft 48, whereas the portion of the face of grind stone 58 which will contact the rail for grinding traces out a curved path as shown at 58P in FIG. 10B. Advantageously, the positioner 50 is operable to change the position and angle of grind stone and, upon a change in angle, the positioner is sufficient (i.e., other adjustments such as adjusting feed stops need not be made) to maintain the grind stone at a proper position to allow the feed jack 70 to apply the grind stone to the rail.

With references also to FIGS. 7 and 10B as well as FIG. 10C, the positioner 50 causes the contact point 58T between the grind stone and the rail to follow path 58P by virtue of vertical and horizontal translation from the pivoting at shaft 48, rotation of the grind stone from the chain 82 turning the shaft 56, elevation of the grind stone changing due to the vertical offset between center point 56C of shaft 56 and center point 58C of grind stone 58 (see FIG. 7), and changes in the portion of the grind stone 58 contacting the rail (see how contact point 58T changes with grind stone position in FIG. 10B).

In order to realize the complex series of motions used to generate path 58P, and with reference to FIG. 7, a preferred embodiment of the present invention has been realized with chain 82 anchored at opposite anchor points (by nuts 86) 12.625 inches apart, shaft 48 centered between the anchor points and 3.015 inches vertically spaced from them, spocket center or lower pivot point 56C disposed 12.392 inches vertically in line and inches below the center of shaft 48 (reference to "vertically" referring to relationships with support tube 46 in vertical position). The chain 82 was realized with 0.625 width chain with a pitch of #50 and mating to sprocket 56 having a pitch diameter of 2.612 inches and 13 teeth.

Figure 11A:
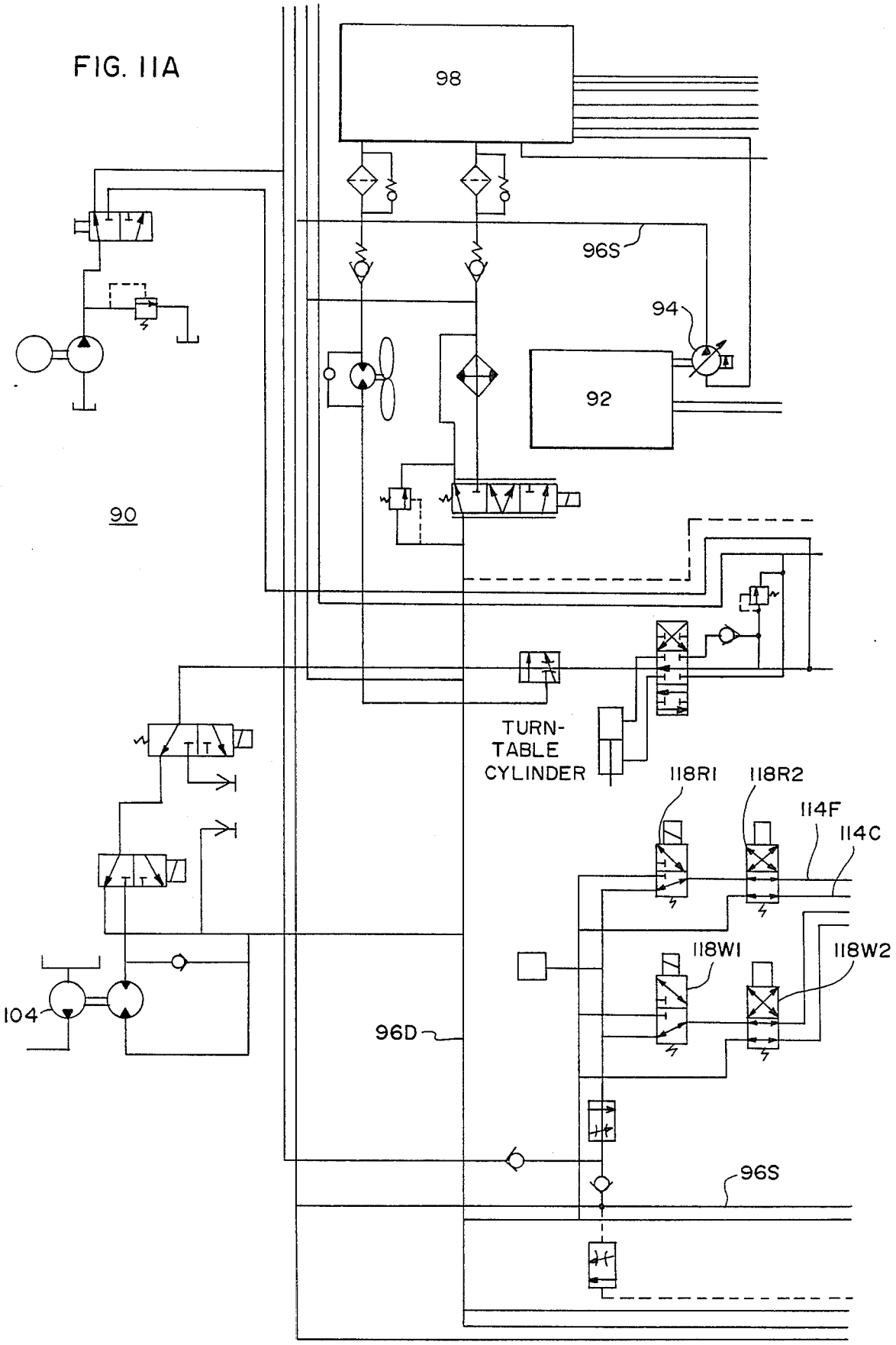
FIGS. 11A, and 11C show partial simplified representations of the hydraulic system of the present invention
Figure 11B:
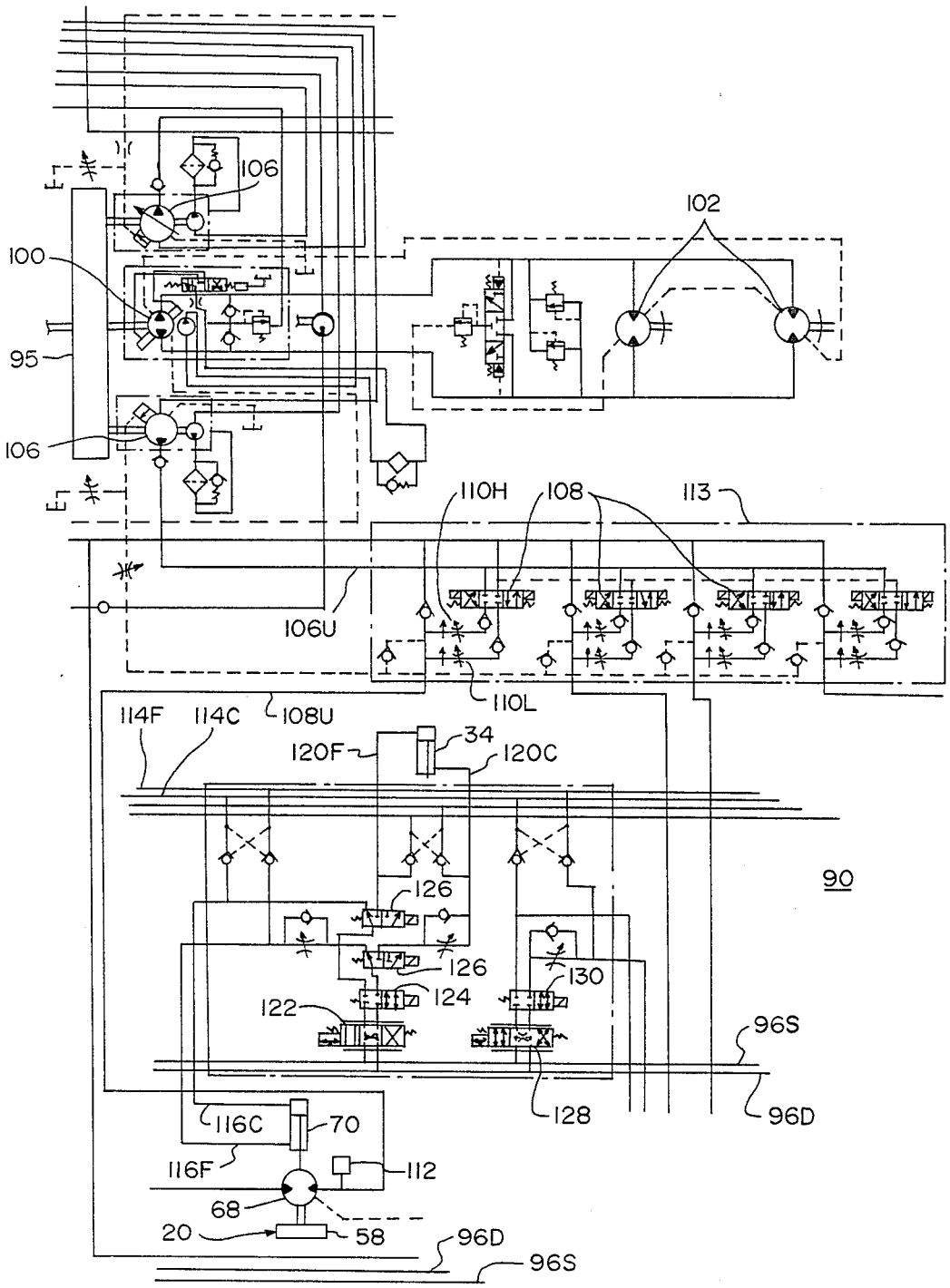
FIG. 11D shows a simplified schematic of part of the hydraulic and electrical parts of the control system of the present invention.
Figure 11C:
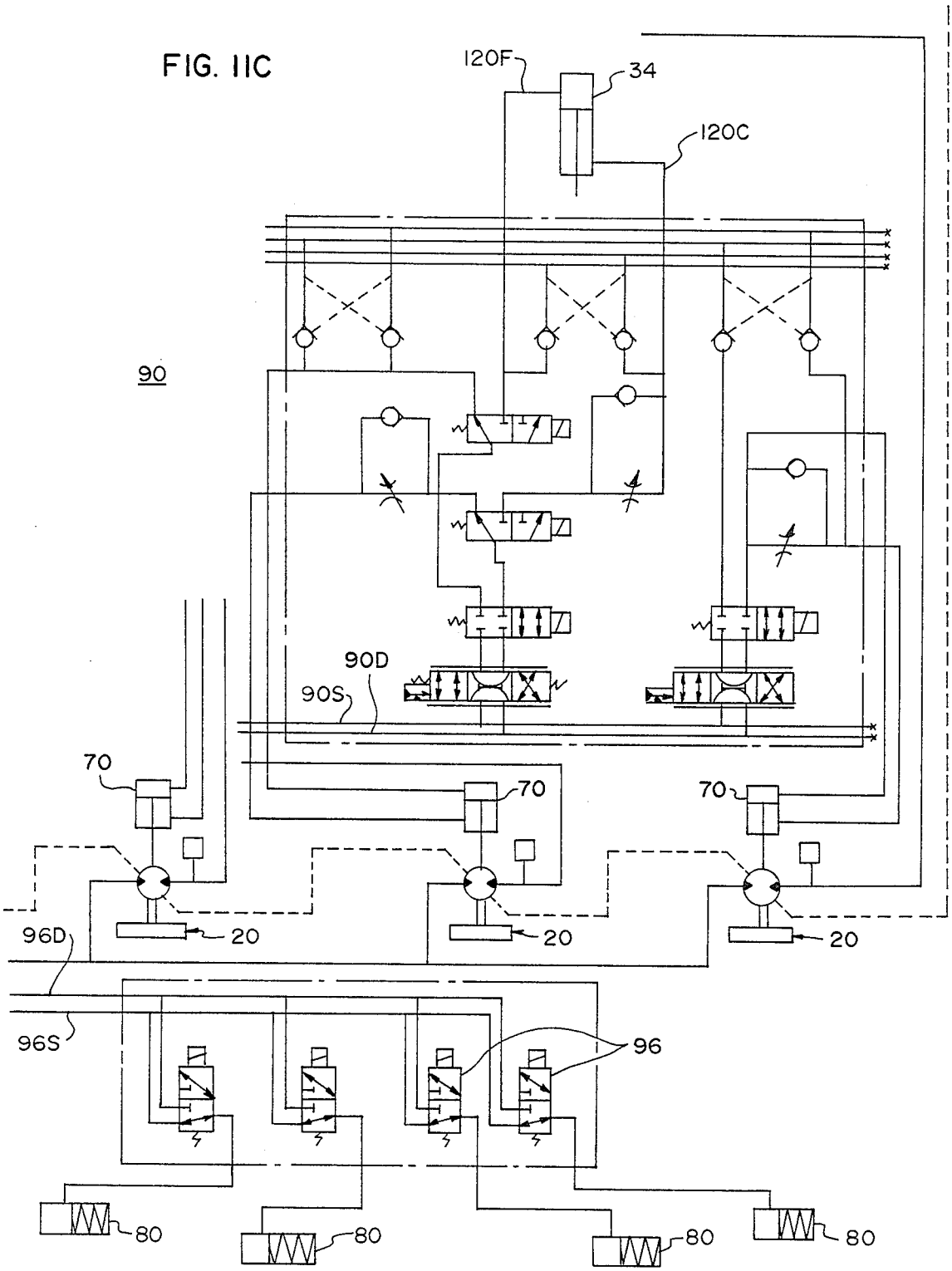

The control system of the present invention includes an hydraulic system 90 as illustrated in FIGS. 11A, 11B, and 11C. FIGS. 11A and 11B are drawn for placement side by side to connect the various control lines, whereas FIG. 11C mates on the right side of FIG. 11B when FIG. 11C is lowered below the upper level of FIG. 11B. The hydraulic connections for the four grinders 20 mounted on one side of the grinder vehicle 10 are illustrated in FIGS. 11A, 11B, and 11C, it being understood that the four grinders 20 mounted upon the opposite side of the grinding vehicle would be connected in identical fashion to the grinders 20 illustrated in these figures. As these figures include numerous components which are not central to an understanding of the present invention, such components need not be discussed in detail.

The hydraulic system 90 has an engine 92 which powers a pump 94 which provides hydraulic fluid to the various feed jacks 70 and the wave control jacks 34. The pump 94 could be mounted on the other side of pump drive 95 if desired. Additionally, the pump 94 supplies hydraulic fluid to the grinder position brakes 80 by way of corresponding valves 96 which may be solenoid operated by the electrical system discussed below. Each of the brake valves 96 is shown in a locked or upper position whereby the brake 80 is connected to a source line 96S. If the valve 96 is moved downwardly, the brake 80 will be connected to a drain line 96D to unlock the brake, each valve 96 thus allowing one to activate and deactivate the corresponding brake 80. The drain line 96D is connected to a hydraulic tank 98.

The engine 92 also powers a pump 100 used to supply power to two hydraulic propulsion motors 102. A water pump 104 may be powered by the hydraulic system along with other generally common components.

The engine 92 further drives pumps 106, each of which is used to power four of the grind motors 68. In particular, the output of pump 106 is fed on line 106U to a series of solenoid operated valves 108, each valve 108 corresponding to an associated grind motor 68. In the position shown in FIG. 11B, the valves 108 are closed. When the valve 108 is moved rightwardly pressurized fluid will flow to an output line 108U by way of a low output flow regulator 110L to turn the associated grind motor 68 at a predetermined constant speed. Alternately, if the grind on/off valve 108 is moved leftwardly from the position of FIG. 11B, pressurized fluid will flow to line 108U by way of a high flow regulator 110H in order to power the grind motor 68 at a higher speed. The regulators 110L and 110H could alternately be rotary flow dividers or other devices to maintain motors 68 at a constant speed. Other speeds could be used as well. It should be noted that various ball or check valves are used for directional control purposes in the hydraulic circuit. For ease of illustration not all of the components such as on/off valve 108 have been separately labeled. Phantom lines show a system for cooling the motors 68 by circulating cooling liquid such as hydraulic oil therein.

Each of the lines 108U is connected to the input of a corresponding grind motor 68 as well as a pressure transducer 112 which provides an eletrical torque signal dependent upon the input pressure of the corresponding motor 68. This input pressure will be proportional to the torque of the motor which, for a given speed of the motor (dependent upon which flow regulator 110H or 110L supplies hydraulic fluid to the motor), indicates the horsepower at which the motor is operating. The output of the pressure transducer 112 will be fed into the electrical system portion of the control system as will be discussed in detail below.

The components within the dotted line labeled 113 are part of a manifold.

With reference now specially to FIGS. 11A and 11B, the hydraulic circuit used to control the feed cylinder 70 and wave control cylinders 34 will be discussed in detail.

First and second rapid independent control lines 114F and 114C are respectively connected to 116F and 116C. The control lines 116F and 116C are used to control the feed cylinder 70 for rapid extension or retraction. In particular, rapid independent control valves 118R1 and 118R2, which preferably are solenoid operated, may be used to supply one of the lines 116F or 116C (depending upon rapid retraction or rapid extension is desired) with a high pressure fluid, whereas the other of the control lines 116F or 116C will be connected to the drain line 96D by way of other valves discussed below. Valve 118R1 alternately connects a source or drain conduit (its inputs on left side) to a signal output line, whereas valve 118R2 connects two inputs (left side) to its two output lines 114F and 114C in either of two possible arrangements. The operation of the valves 118R1 and 118R2 would be used to control all of the grinders on one side of the vehicle, it being understood that a symmetrically constructed hydraulic circuit could be used to control the grind stones on the opposite side of the vehicle. The valves 118R1 and 118R2 provide the rapid extension or retraction when the system is in an independent mode the details of which will be discussed below.

When the system is in a wave control mode such that the grind stones are applied against the rail by control of the wave control cylinders 34, valves 118W1 and 118W2 may be used for rapid extension and retraction of the wave control cylinders 34 by their control lines 120F and 120C. It will be readily understood that valves 118W1 and 118W2 provide rapid extension and rapid retraction in identical fashion to the operation of the valves 118R1 and 118R2 respectively.

The hydraulic system 90 will be used in an independent mode wherein each grind stone 58 grinds when applied against the rail by operation of its feed cylinder 70 such that each grind stone may assume a different work position depending on control of its feed cylinder. In the independent mode, the wave control cylinders 34 would be maintained in a steady state such that the K frame (refer back momentarily to part 28 of FIG. 5) is stationary.

The hydraulic system 90 is operable in the wave control mode wherein grinding occurs with the feed cylinders 70 of a pair of grinders 20 mounted to a particular K frame 28 (not shown in FIGS. 11A, 11B, or 11C) are maintained in a steady state and the two grind stones 58 of the pair of grinders are moved up and down dependent on rail variation by operation of the wave control cylinder 34 associated with the particular K frame which is operating in the wave control mode. The feed cylinders 70 in the two grinders 20 operated in such a wave control mode would be set at a common stroke (by way of valves 118R1 and 118R2) so as to effectively increase the diameter of the grind stones 58 due to the separation between such a pair of grind stones. In other words, the grind stones 58 would resist the tendency to track the rail down into a dip of a wave formed in the rail because one of the pair of grind stones 58 would likely be disposed upon a peak in the wave when the other of the grind stones 58 is over a valley or dip such that the grind stones would not follow the rail down into the valley.

A pressure control pilot valve 122 receives inputs from control lines 96S and 96D and is used to change the position of the wave control cylinder 34 (of FIG. 11B) and the feed cylinder 70 of FIG. 11B depending upon the mode in which the system is operating. As shown, the valve 122 has a center off position and, alternately, allows straight through connections between its two inputs and its two outputs and cross-over connections between its two inputs and its two outputs. An on/off solenoid valve receives the outputs of the valve 122. When the valve 124 is on or open, it connects the output lines of valve 122 to the two valves 126. The two valves 126 function as mode valve means to control the mode of operation. Specifically, when the valves 126 are in the position shown, the source and drain lines 96S and 96D will be connected to the feed cylinder control lines 116F and 116C depending upon the position of valve 122. When the valves 126 are moved leftwardly, as by electrical solenoid control, the lines 96S and 96D will be connected to the wave control feed cylinder 34 by way of lines 120F and 120C, the connection again depending upon operation of valve 122. The valves 126, which serve as the mode valve means, could be directly controlled by an electrical solenoid or alternately controlled by way of a pilot hydraulic valve.

A pressure control pilot valve 128 and on/off valve 130 control the left-most cylinder 70 of FIG. 11C and operate in substantially the same fashion respectively as the valves 122 and 124. However, the valves 128 and 130 are unlike valves 122 and 124 in that valves 128 and 130 do not have a switching arrangement to connect through to the wave control cylinder 34 when the system is in the wave control mode. The valve 130 would be switched to off to maintain its associated cylinder 70 stationary when the system is in the wave control mode.

The set of valves 122, 124, 126, 128, and 130 and the associated check valves and flow regulators are included for each of the three cylinders (two feed cylinders 70 and one wave cylinder 34 associated with a particular K-frame) used in the grinder vehicle.

As will be noted from the FIGS. 11A, 11B, and 11C, separate hydraulic circuits are used for controlling the rotation motors 68 and the cylinders 70 and 34. The rotation motors 68 may include a hydraulic fluid flushing and cooling arrangement shown in phantom line. High flow rate, high pressure hydraulic fluid is used to power the various hydraulic rotation motors 68, whereas the hydraulic fluid supplied to the feed cylinder 70 and wave control cylinders 34 is of lower pressure and flow rate.

The pressure controlled pilot valves 122 and 128 supply a variable pressure which forces (by way of cylinders 70 or 34 depending on the mode) the grind stones into the rail with a varying amount of force. Depending upon the current supplied to the pressure controlled pilot valve 122 (or 128), the valve 122 will supply a given amount of pressure to the feed jack or control jack. This is advantageous in that the hydraulic system may instantly respond to a bump in the rail due to the tendency of the valve 122 to maintain the pressure constant for a given input current. In other words, the hydraulic system may respond to irregularities in the rail even before the electronic system, discussed in detail below, is required to change the input current to the valve 122. As will be discussed in detail below in conjunction with the electrical system which controls the hydraulic system, the pressure transducer 112 outputs an electrical signal proportional to the input pressure on the motor 68, this input pressure being proportional to the torque of the motor 68. For a given speed, this torque signal is representative of the horsepower of the motor and, indirectly, the grinding power applied to the rail. The torque signal is fed to the electrical system which will operate the valves 122 and 128 which control the cylinders 70 and 34 (depending upon the mode) to maintain the torque and, thus, the horsepower constant. The actual bearing pressure of the grind stone 58 upon a rail will vary depending upon the rail itself. That is, maintenance of a constant motor horsepower may require different bearing pressure based upon the texture, hardness, and presence of oil on the rail, among other factors. Such factors change the coefficient of friction of the grind stone relative to the rail such that maintaining a constant bearing pressure of the grind stone on the rail will not necessarily maintain the grinding power into the rail constant. Thus, although the valves 122 and 128 are operable to apply the grind stones 58 against a rail with a constant pressure for a given electrical signal supplied to the valves 122 and 128, the pressure will be changing based upon changes in the current supplied to the valves 122 and 128.

Figure 11D:
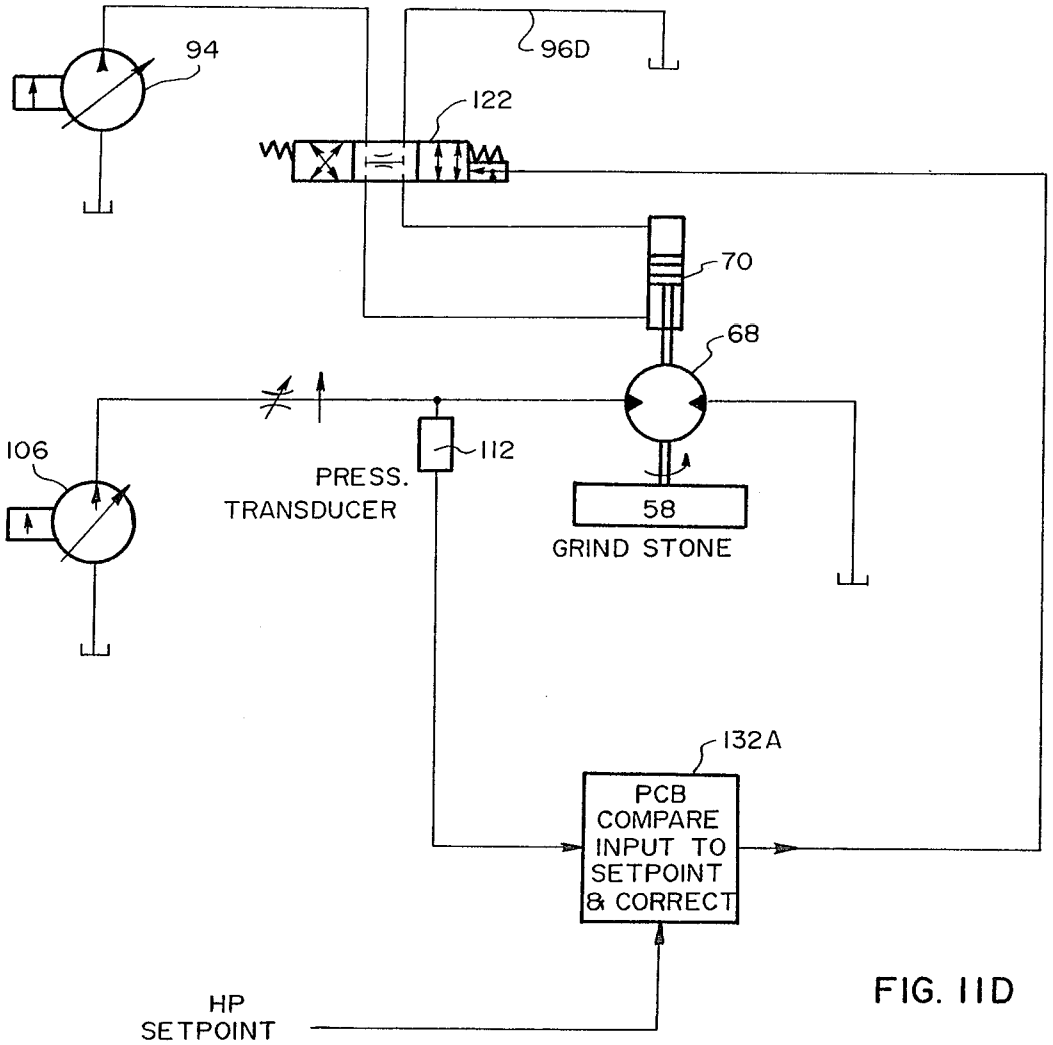

Before explaining the details of the electronic system, it is useful to describe the basic principles of cooperation between the hydraulics and the electronics by reference to the simplified schematic of FIG. 11D showing a feed cylinder 70, grind motor 68 with its input connected to pump 106 and having pressure transducer 112 connected to sense the back pressure (and thus the torque) of motor 68, grind stone 58, pressure controlled pilot valve 122, and feed pump 94. The pressure transducer 112 outputs an electrical signal dependent on the torque. This signal, which for convenience may be referred to as a "torque signal", will also be representative of the horsepower of motor 68 as the motor is operating at either of two constant speeds. (The same principles of operation as described hereafter could be used for motors with different speeds by multiplying the motor speed by its torque to generate an actual power signal.)

The torque signal is compared to a horse power set point signal in control board 132A which outputs a signal to operate valve 122. Valve 122 (and identically operating valve 128 not shown in FIG. 11D) produces a hydraulic differential pressure output proportional to a direct current input. The valve, which for example could be a SUNDSTRAND brand MCV101A valve, is a closed loop pressure control valve using internal hydraulic pressure reactions to effect an intrinsic feedback. The output of the board 132A will control the valve 122 to change the differential pressure supplied to feed cylinder 70 in order to maintain the pressure sensed in transducer 112 constant, thereby maintaining the power of motor 68 constant (i.e., within the response time and characteristics of the feedback arrangement).

As an example of the operation of the FIG. 11D arrangement, if the grind stone 58 comes to a portion of rail having a smoother texture than the preceding portion, the friction of contact between the grind stone 58 and the rail will go down. This will lesson the torque and the back pressure of motor 68 as will be indicated by a change in the torque signal from transducer 112. The control board 132A will increase the currect to valve 122 which in turn will output a greater differential pressure to cause cylinder 70 to press the grind stone 58 harder into the rail such that the torque (power) of motor 68 returns (i.e., is maintained) to its original valve corresponding to the horse power setpoint. The valve 122 may operate the wave cylinder 34 (not shown in FIG. 11D) under a similiar principle of operation when the system is in the wave mode.

Figure 12A:
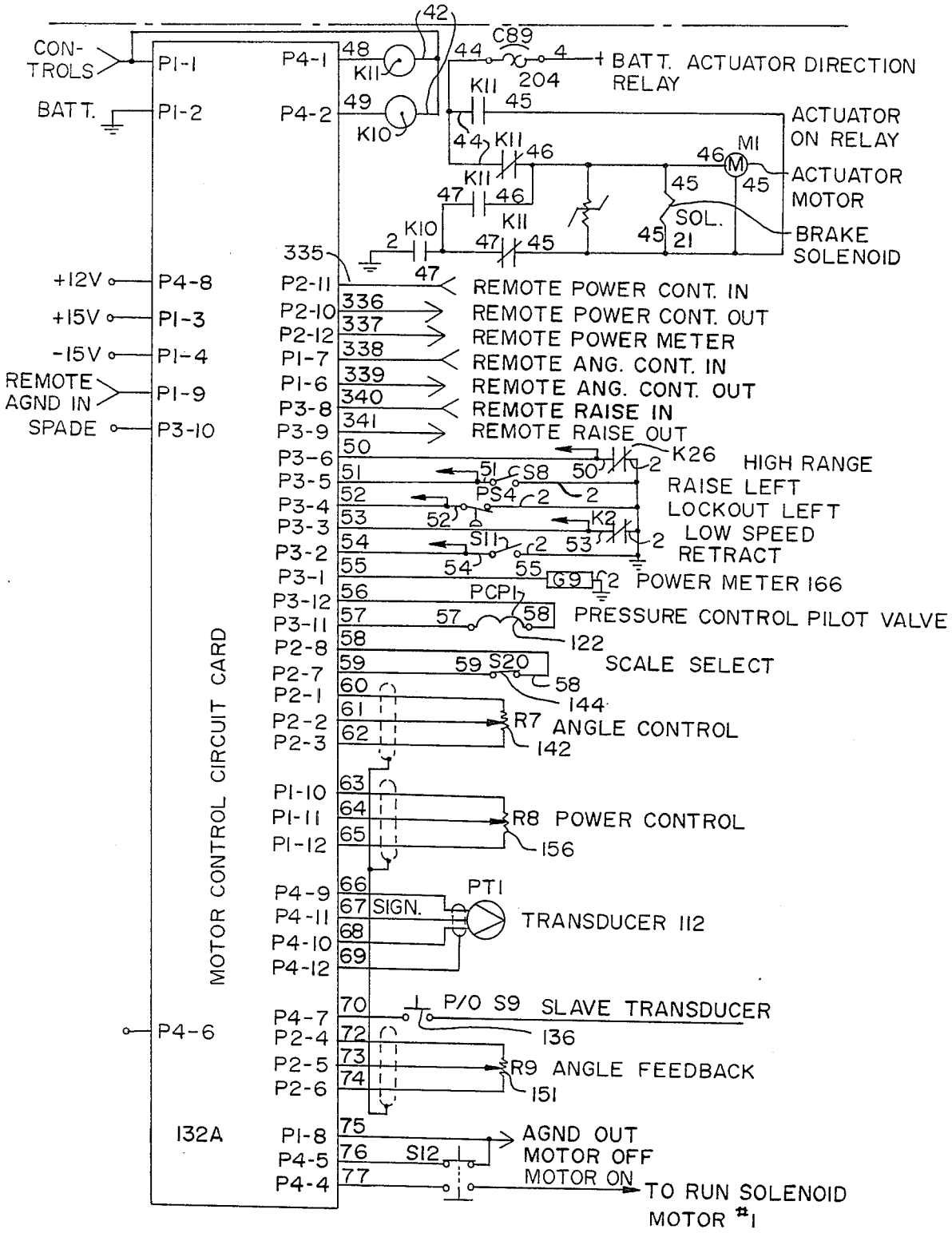
FIGS. 12A and 12B show the circuit cards of an electrical control system used with the present invention.
Figure 12B:
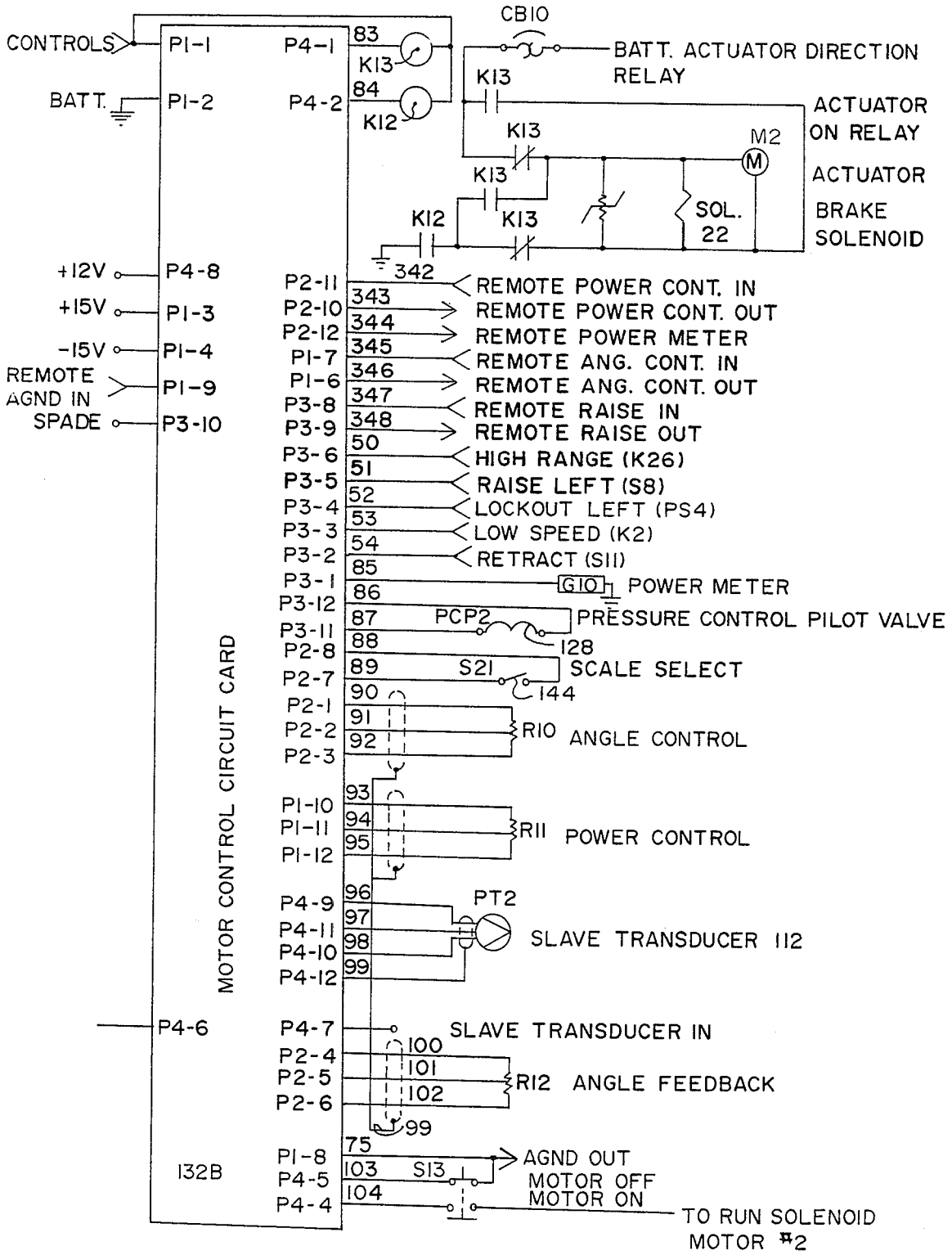

With reference now to FIGS. 12A and 12B, the electrical system portion of the control system used with the present invention will be discussed. FIG. 12A shows a motor control circuit card 132A, whereas FIG. 12B shows a motor control circuit card 132B, the input labeled "slave transducer" of card 132A being fed from output terminal P4-6 of control card 132B. The control card 132A would be used in the independent mode to control one of the grinders, whereas the control card 132B would be used in the independent mode to control the other grinder mounted to a common K frame. In the wave mode, the card 132A would be used to control both grinders upon a particular K frame 28 with which the cards 132A and 132B are associated.

Figure 13A:
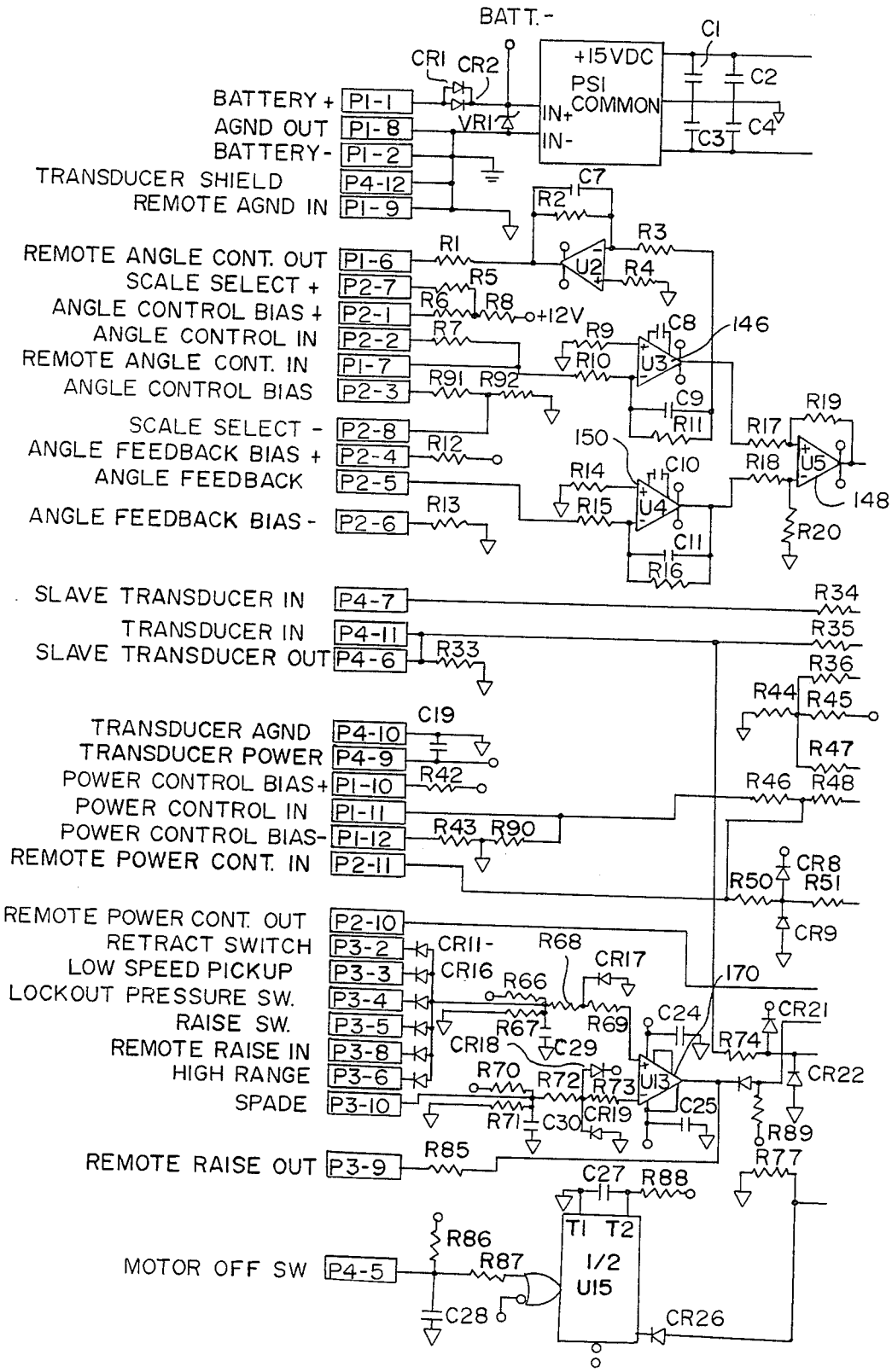
FIGS. 13A and 13B show an electrical circuit arrangement used for the control cards.
Figure 13B:
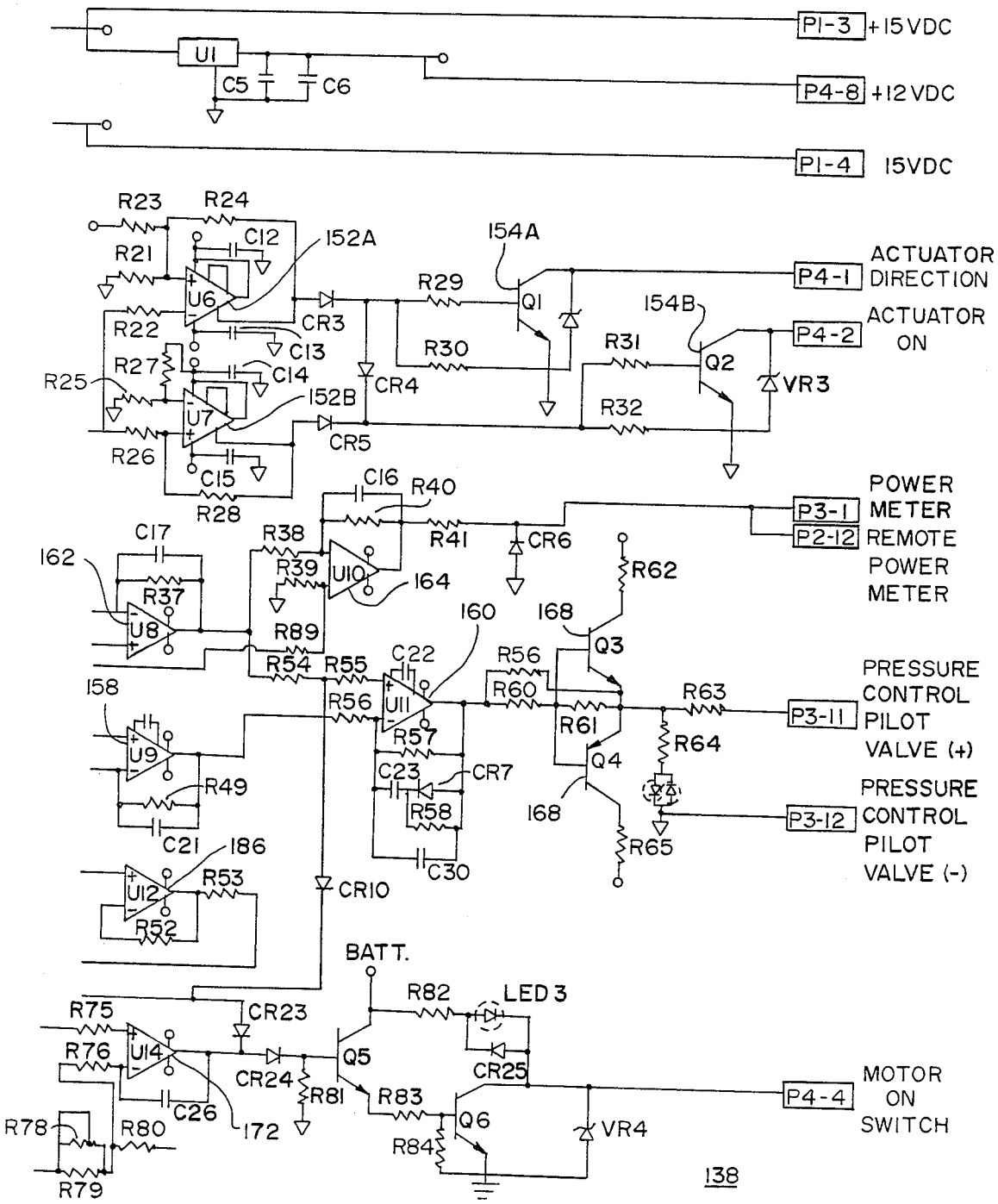

Continuing to view FIGS. 12A and 12B, but also considering the details of control card 132A as shown in FIGS. 13A and 13B and the control circuit console of FIG. 14, the central features of the electrical control system will be discussed.

The motor control circuit card 132A is operable in the independent mode to control the position of one of the grind stones 58, whereas the circuit card 132B will control the position of the other of the grind stones 58 supported from a common K frame 28 as the grind stone controlled by 132A. When in the wave control mode, the motor control card 132A is operable to control the positioning of both of the grind stones 58 mounted upon a particular K frame 28 associated with the cards 132A and 132B. Each pair of grinders 20 supported from a common K frame 28 would have associated control cards 132A and 132B such that the preferred embodiment of the invention would use four such pairs of control cards.

The console 134 includes an mode controller switch 136 which can set the system in an independent mode such that each grinder 20 is separately controlled to maintain a constant motor power (i.e., within the response time of a feedback loop). The on/off control 140 on the console 134 is used to turn the other controls on and off. Mode controller 136 may be disposed in one position to render the hydraulic mode valve means 126 (in the hydraulic circuit) in an independent mode (valve 130 also open) and in another position to render the valves 126 in a wave control mode (valve 130 closed). The mode controller may use electrical signals to operate solenoids for switching the valves 126, but various other techniques could be used and the specifics need not be described in detail herein.

Associated with each of the grinders 20 is a head angle control potentiometer 142. The angle control 142 may set the angle of the grind stone grinding surface continuously (i.e., not limited to a finite number of settings) at between 90° on the field side and 90° on the gauge side with the middle point being 0° corresponding to the grinding surface disposed parallel to the upper surface of the rail (usually horizontal, but may vary depending on rail cant). Although not shown in FIG. 14, the angle control 142 may have indicia around it to label the 180° range. Additionally, it may include indicia for using angle control 142 about a more limited range such as between 30° on the field side and 30° on the gauge side. A scale select switch 144 (FIG. 12A) is used by way of inputs P2-7 and P2-8 (FIG. 13A) to determine whether the angle control 142 is operating over a range of 60° or over its wider range of 180°.

The "angle control in" is fed to operational amplifier 146 whose output is representative of the desired angle as set by the angle control 142.

Various resistors, capacitors, and diodes are used in the circuit of FIGS. 13A and 13B for filtering, level adjustment, and various other purposes. To avoid obscuring the central points of the present invention and considering that one of skill in this field would readily understand the operation of such components, these components need not be discussed herein.

The output of the amplifier 146 representative of the desired angle for the grind stone face is fed into one input of an angle feedback amplifier 148, the other input of which is representative of the actual angle of the grind stone face as output by amplifier 150. The amplifier 150 derives the actual angle signal fed to amplifier 148 by virtue of its connection to an angle feedback potentiometer 151 (FIG. 12A). The angle feedback 151 may simply be a potentiometer disposed within the electric actuator serving as positioner 50 (FIG.7). In such a case, the output of the amplifier 150 will be dependent upon the length to which the positioner 50 is extended, each length corresponding to a particular angle.

The output of amplifier 148 is an error signal dependent upon the difference between the actual angle of the grind stones as determined by the electric actuator 50 and the desired angle of the grind stone. This output is fed into amplifiers 152A and 152B (FIG. 13B), which amplifiers control the electric actuator for positioner 50 by way of transistors 154A and 154B. With reference to the top of FIG. 12A, an arrangement of relays K10 and K11 are used to control the actuator motor of positioner 50 and the brake solenoid which would control the operation of one of the brake valves 96 (refer back momentarily to FIG. 11C). The relay arrangement shown is such that the brake 80 will not be locked when the actuator motor of positioner 50 is in operation.

A power control potentiometer 156 (FIGS. 14 and 12A) determines the amount of grinding power applied to the rail by the grind stone. With reference to FIGS. 13A and 13B, the power control in signal from the power control 156 is supplied to an amplifier 158 which functions with its associated components as a noise filter and scaling circuit. The output of amplifier 158 is fed as desired power level signal to an input of amplifier 160. The other input of the amplifier 160 is an output of a noise filtering and scaling amplifier 162. A capacitor C30 may be used to stabilize the feedback loop of which amplifier 160 is a part. The scaling amplifier 162 is connected to the pressure transducer 112 (FIG. 12A) so as to output a signal based upon the torque of the grind motor 68. For a given speed as set by valves 108 through flow controllers 110H or 110L (refer back momentarily to FIG. 11B), this output signal will be representative of the actual motor power. (The valves 108 of FIG. 11B may be controlled by a speed switch not shown.) The output of amplifier 162 is additionally fed as an input to a scaling amplifier 164 which outputs a signal to a power meter 166. The power meter 166 shows the motor power and may be marked in terms of horsepower. As shown, some of the power meters show power for either mode of operation, whereas other meters are only used in the independent mode. The comparision amplifier 160 compares the actual horsepower signal output by amplifier 162 and the desired horsepower signal output by amplifier 158 and generates an output signal which controls the pressure control pilot valve 122 by way of transistors 168. When the actual horsepower and the desired horsepower are equal, the amplifier 160 and transistors 168 together with associated components will provide a constant current to the pressure control pilot valve 122 in order to maintain a given pressure in the cylinder 70 or 34 depending on the mode and, thus, a given force of the grind stone against the rail. However, when the grind stone moves to a portion of the rail having a different vertical level or a different coefficient of friction, such as a portion coated with oil or with a different texture, the output of amplifier 162 will reflect the change in torque or horsepower. For example, the grind stone contacting a portion of rail will have a smaller amount of torque for a given pressure such that the pressure will be increased until the torque is reset to match the signal out of amplifier 158. The torque of course will correspond to the horsepower for a given speed as mentioned above.

Various circuit components are shown at the bottom of FIGS. 13A and 13B, which components are not central to the present invention and will simply be briefly mentioned. An amplifier 170 is used for rapid retraction of the grinders upon switching of various switches or occurance of particular conditions, whereas an amplifier 172 receives the output of the pressure transducer 112 and is used to cause rapid retraction of the grind stones if the actual horsepower is below a predetermined level or upon a broken hydraulic hose, etc. An on/off switch 174 (FIG. 14) is connected in the bottom of the circuit of FIGS. 13A and 13B to insure that the grind stone is not placed against the rail by operation of the grind switch until after the particular grind motor has been turned on. The top of the circuit diagram of FIGS. 13A and 13B shows power circuitry.

The operation of the electrical system 138 for a particular grinder 20 when the grinders are disposed in the independent mode involves each of the grinders being controlled by its own control card which would be constructed essentially like the circuit of FIGS. 13A and 13B. However, the motor control circuit card 132B is slightly different from 132A shown in FIGS. 13A and 13B in that the motor control circuit card 132B supplies the torque signal from slave transducer 112 (FIG. 12B) to the feedback loop having amplifier 162 in FIG. 13B when the two grinders associated with those two circuit cards are disposed in the wave control mode. In particular, the operation in the wave control mode would include the inputting of a slave pressure transducer 112 (FIG. 12B) by way of the closure of switch 136 corresponding to the mode controller. Under such circumstances, the slave transducer input is fed into scaling amplifier 162 which then outputs a signal based upon the sum of the power of both of the tandem or coupled together grinders. The amplifier 160 will then compare the actual power of the two grinders to the desired horsepower and will use that comparison to control the wave mode pressure control valve 122. (An alternate arrangement shown in FIG. 15 and discussed below may select the greatest torque signal as the control input valve to the feedback loop.) With momentary reference back to the hydraulic arrangement of FIG. 11B, the valves 126 serving as mode valve means will cause the pressure control valve 122 to supply its output to the wave control cylinder 34 such that the sum of power of both grinders is maintained constant. This is highly advantageous in that both grinders will be maintained at a common vertical level (the hydraulic valving arrangement will have switched the feed cylinders 70 to a common stroke length and constant steady state) such that the passage of one grind stone over a valley in a wave may correspond to the presence of the other grinder at a peak in the wave on the rail. Because the grinders or grind stones will be coupled together at a common vertical level, the grind stone over the valley will not follow the rail down into the valley. Thus, that grinder will sense very little resistance torque and its horsepower grinding into the rail will be quite low. However, because of the use of the wave control cylinder 34 and the operation of amplifier 160 and associated circuitry, the pressure control pilot valve 122 will insure that the grind stone on the peak of the wave grinds at a higher horsepower level. For example, if the two grind stones are collectively grinding at 20 horsepower, the motor controlling the grinder over the valley may drop to 5 horsepower, whereas the motor of the grind stone over the peak may increase to 15 horsepower. The sum of the power of the motors will be maintained essentially constant with a variable distribution of power between them under the illustrate power feedback loop shown in FIGS. 13A and 13B. This is highly advantageous in that the grinding power will be applied at a maximum at the peaks in the wave and with a minimal amount in the valleys of a wave in the rail.

Figure 15:
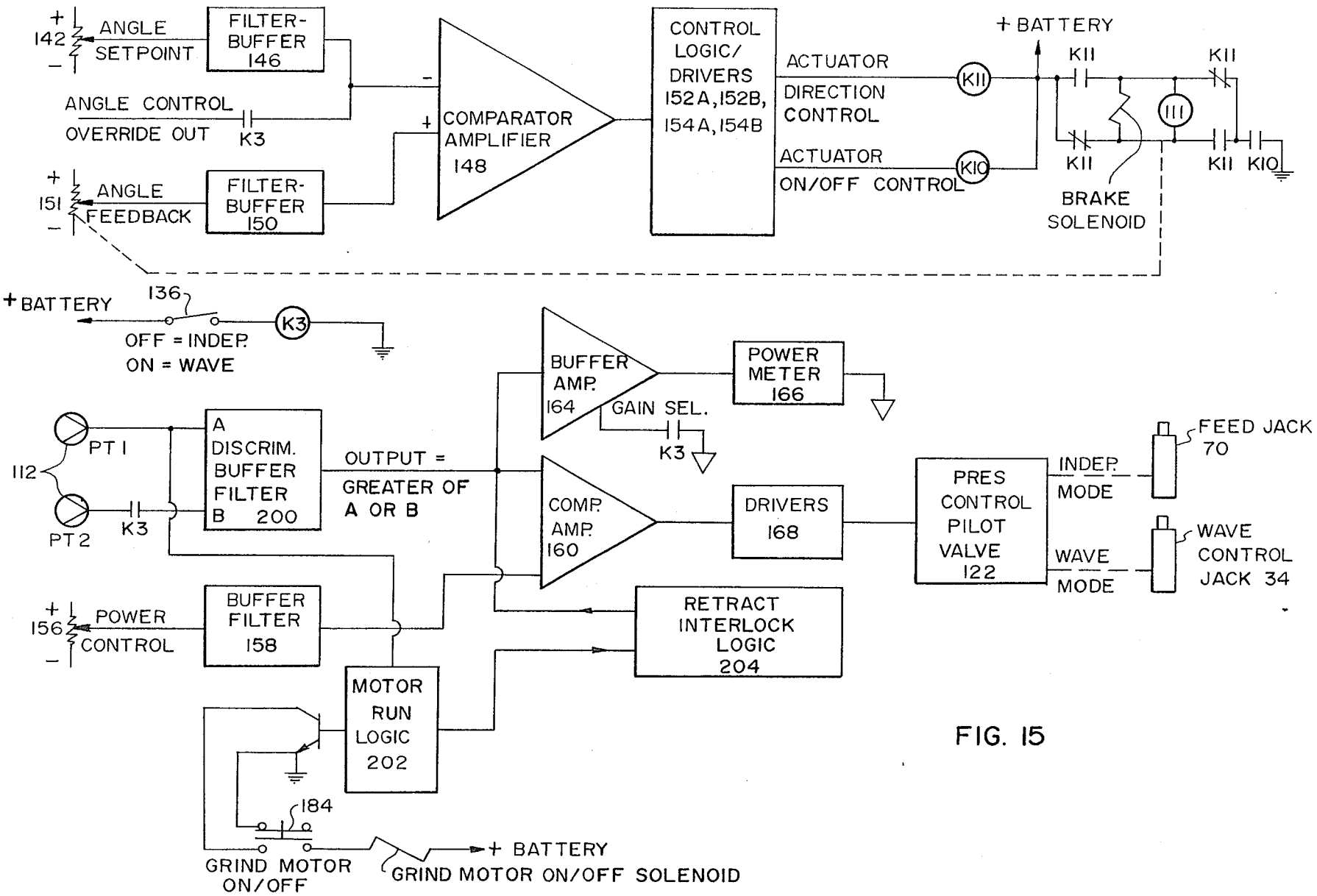
FIG. 15 is a block diagram of an alternate circuit arrangement as used with the present invention.

With reference now to FIG. 15, a simplified block diagram of an alternate feedback arrangement for the present invention will be discussed. For convenience, the components of the arrangement of FIG. 15 have been labeled with the same number as the corresponding component (if any) previously illustrated in FIGS. 12A, 12B, 13A, 13B, and/or 14.

The top portion of FIG. 15 (at or above the angle feedback potentiometer 151) illustrates how the angle set point control 142 is compared to the actual angle by comparator amplifier 148 and used to generate an error signal which controls the motor M1 of the actuator or positioner 50 (positioner shown in FIG. 7). As the motor M1 controls the angle feedback potentiometer 151 by virute of potentiometer 151 being mounted within the actuator or positioner 50, the amplifier 148 serves as an angle control feedback amplifier which will stabilize the grind stone at a particular angle set by the angle set point potentiometer 142.

As an optional feature, the output of filter 146 may pass through a set of switches K3 to provide an "angle control override out" for operation in the wave control mode. Upon the closing of the mode controller switch 136, the coil K3 corresponding to switch contacts K3 will be activated such that the switch contacts K3 will close and provide the "angle control override out" signal. This signal may be used as an override to supply the angle feedback amplifier 148 of a different control card such that the angle set point control 142 of FIG. 15 may serve to control the angle of two grinders when the control system is in the wave control mode. For example, the angle control override out signal could be used as an alternate input to the filter-buffer 146 on a slave card. Relay switches or other arrangements could be used such that the angle feedback amplifier 148 of the slave card would control the associated grinder to assume the angle set by the angle control 142 of the master card.

The power feedback arrangement of FIG. 15 is different from that previously shown in that the wave control mode would use a discriminator 200 to output the greater of the torque or pressure signals from the transducers 112. The PT1 transducer would be used in the independent mode to control the pressure control pilot valve 122, whereas the PT2 pressure transducer would normally control the pressure control pilot valve 128 (FIG. 11B only) by way of a separate feedback loop essentially similiar to that of FIG. 15 except that the discriminator-buffer-filter 200 would simply be a buffer-filter in the feedback loop (not shown) used for pilot valve 128. In the wave control mode, the switch contacts K3 will switch through the torque signal from transducer PT2 to the discriminator 200 such that the discriminator 200 will select the highest signal from the two transducers 112 as the output supplied to power feedback amplifier 160. The amplifier 160 would then compare the signal from discriminator 200 representing the actual power of the motor operating at the highest power (between the two motors corresponding to transducers 112) to the desired power as set by the power control potentiometer 156. The amplifier 160 would control the pressure control pilot valve 122 to maintain (i.e., within the response time of the feedback loop) at least one of the motors operating at the desired power level. In the wave mode, the valve 122 would of course control the wave control jack 34 as schematically illustrated at the right of valve 122 in FIG. 15.

As an example of operation in the wave control mode with the configuration of FIG. 15, the power control potentiometer 156 could be set for 20 horsepower. If the rail was level at a point, each of the motors associated with corresponding transducers PT1 and PT2 would be operating at 20 horsepower. Upon the grind stone associated with the transducer PT1 (i.e., the grind stone whose drive motor is sensed by PT1) becoming disposed over a dip or valley in the rail surface, the output of transducer PT1 will drop corresponding to the lower torque and power in the motor. However, the motor corresponding to PT2 will continue to operate at 20 horsepower by virtue of discriminator 200 selecting that output as the control value fed into the feedback loop of amplifier 160. The feedback loop will maintain the wave control jack 34 at sufficient pressure to maintain the motor corresponding to transducer PT2 at 20 horsepower at that time. Thus, the motor corresponding to PT1 may drop to, for example, five horsepower, while the motor corresponding to PT2 will continue grinding at 20 horsepower. Upon the motor corresponding to PT2 reaching the dip or valley in the rail surface, the grind stone corresponding to PT1 will likely not remain in a dip in the rail. Accordingly, the power of the motor corresponding to PT2 might now dip to five horsepower, but the motor corresponding to PT1 will have a higher power level and will be supplied as the control value to the power feedback amplifier 160 to maintain that motor at 20 horsepower. Accordingly, the wave control jack 34 will in this manner be controlled by the motor having the higher power output at a particular time. At any given moment, the power of at least of the motors will be maintained (i.e., within the response time of the feedback loop) at the predetermined power set by power control 156, whereas the other motor will be operating a power a level no greater than that power.

Motor control logic 202 and retract/interlock logic 204 may be used to control the flow of hydraulic fluid to the motor and the retraction of the grinders under various conditions. For example, the retract interlock logic 204 may be used to automatically retract the grinders if the vehicle is operating at such a low speed as to pose problems. Additionally, this logic may automatically retract the grinders upon high range, motor off, lock-out sequence, raise switch operation, retract switch operation, and retraction of second motor conditions.

The feedback arrangement of FIGS. 13A and 13B which uses the sum of the transducer outputs as the control variable in the feedback loop when grinding in the wave control mode will not only decrease the power of a motor whose grind stone is over a valley, but it will also increase the power of the motor whose grind stone is over a peak in the rail surface. On the other hand, this arrangement of FIGS. 13A and 13B will limit the sum of the powers of the two motors associated with a particular K-frame to the rated safe limit for the power of a single motor. For example, if it is decided that each of the motors 68 should not be operated at more than 20 horsepower, the sum of the motor powers cannot exceed 20 horsepower when the power feedback arrangement of FIGS. 13A and 13B is used. On the other hand, the feedback arrangement of FIG. 15 which uses the selected highest motor torque or power as the control value in its feedback loop would allow one to operate each motor at its highest rated value of 20 horsepower without danger of a lowering of power in one motor caused by a dip in the rail resulting in an increase in power in the other motor beyond the 20 horsepower limit.

Independent Mode

Placing the motor in the independent mode whrerein all of the grind stones are fed independently may be accomplished by the following procedure:

1. With the engine running at maximum gov. rpm and the mode switches or controllers for both sides of the machine in the independent, retract, and raise positions, the control power may be turned on at switch 140 to activate the electronic grinding horsepower and angle controls. This may also be used to lower spark curtains.

2. Select the desired grind horsepower and grind stone angle for each stone being used by operation of controls 156 and 142 respectively (controls shown in FIG. 14). During this step, the valves 96 (FIG. 11C) will be operated by the brake solenoids (one shown at top of FIG. 12A) to release the brakes 80 until the particular grind stone has assumed its proper angle.

3. Decide upon the proper stone speed. High speed (5500 rpm) may be selected only for 6 inch or 4 inch diameter stones. Low speed (3600 rpm) is used for 10 inch diameter stones. Depending upon the speed which is selected, the valves 108 (FIG. 11B) will assume different positions to allow hydraulic fluid flow through either the high flow regulator 110H or the low flow regulator 110L upon operation of the corresponding grind motor control switch 174.

4. Following the turning on of the grinders by operation of the switches 174, the transmission is placed in low range and the desired travel speed (0.525 miles per hour) is attained via the propulsion system.

5. Select (lower) on the raise/lower top toggle switches 175 (FIG. 14) on the control panel to extend and hydraulically lock the K-frame wave control cylinders 34 (FIG. 5). Placing the switch 175 in its lower position will energize solenoids corresponding to valves 118W2, which then allows hydraulic fluid to extend and hold both K-frames on a particular side of the machine down by operation of the control jacks 34 corresponding to the K-frames, and operates a solenoid corresponding to valve 118R1, which relieves hydraulic pressure on the rod ends of the independent feed cylinders 70 in preparation for the "grind" mode of step 6 below. Operation of the raise/lower toggle switch 175 for the other side of the machine would operate in identical fashion.

6. Select "grind" on the retract/grind toggle switches 176 (although a single such switch is shown in FIG. 14, separate switches for the two sides of the machine may be used as well). This will allow the stones to be fed to the rail by energizing solenoids corresponding to valves 124 and 130 such that hydraulic power will be communicated to the independent feed cylinders 70. The pressure level on the head and rods ends of the cylinders 70 will be controlled by a corresponding one of the pressure control pilot valves 122 and 128 and the actual pressure may vary to maintain each motor at the preset horsepower level once the grind stone is on the rail.

7. Stone retract may be accomplished by selecting "raise" on one or both of the switches 175 to electrically bias the pressure control pilot valves 122 and 128 to deliver fluid to the rod ends of the independent feed cylinders 70 causing full retraction of these cylinders. Alternately, "retract" may be selected one or both sides of the control panel to deenergize the solenoid corresponding to valve 118W2 (and/or the similiar valve controlling the opposite side of the vehicle) to direct fluid to the rod ends of the K-frame or control cylinders 34 causing them to retract fully. Reducing travel speed below a preset minimum value will automatically raise the grind stones by biasing of the pressure control pilot valves 122 and 128.

8. When the grinding operation is complete, the retract/grind switches 176 should be placed in "retract", the raise/lower switches 175 should be placed in "raise" and all motor switches 174 should be turned to the "off" position. Control power should then be turned off by the switch 140. All solenoids will then be deenergized.

Wave Mode

In the wave mode, a pair of grind stones supported by a common K-frame or grinder assembly mounting frame 28 will be locked together as a unit for movement in unison and fed into the rail to remove long wave rail head irregularities. The steps are similiar to those outlined above for the independent mode where noted as follows:

1. Same as step one of the independent mode except that the independent/wave switch 136 has been placed in the "wave" position. This energizes solenoids corresponding to valves 126 such that these valves will now allow the pressure control pilot valves 128 to communicate with the wave control cylinders 34.

2. Adjust all stone angles to 0°, the hydraulic brakes 80 operating as reference in step 2 of the independent mode to lock the mechanisms at the proper angle following the assumption of the correct angles.

3. Same as step 3 in the independent mode.

4. Same as step 4 in the independent mode.

5. Select "lower" on the raise/lower toggle switches 175 of the control panel to extend and hydraulically lock the independent feed cylinders. In this mode, the solenoid corresponding to valve 118R2 will be actuated to allow hydraulic fluid to extend and hold all of the independent feed cylinders 70 associated with the particular side of the vehicle. Addtionally, the solenoid corresponding to the valve 118W1 will be actuated to relieve hydraulic pressure on the rod ends of the K-frame or wave control cylinders 34 of the particular side. Again, both sides will operate in the same fashion such that separate decription for each side need not be given.

6. Select "grind" on the retract/grind toggle switches or switch 176 to allow the stones to be fed into the rail. Selection of the "grind" position will energize the solenoids corresponding to valves 124 such that the pressure controlled pilot valves 122 may control the associated wave control cylinder 34. The pressure level on the head and rod ends of the wave cylinders 34 will be determined by the preset horsepower level on the control panel and will be maintained automatically under one of the feedback arrangement discussed in detail above.

7. Stone retract is accomplished in the same fashion as discussed in step 7 above for the independent mode except that the selection of "raise" will retract the grinders by the wave control cylinders 34 (instead of the feed cylinders 70) and the selection of the "retract" will cause full retraction of the feed cylindes 70 (instead of the wave control cylinders 34).

8. This step is the same as step number 8 in the independent mode.

Figure 16:
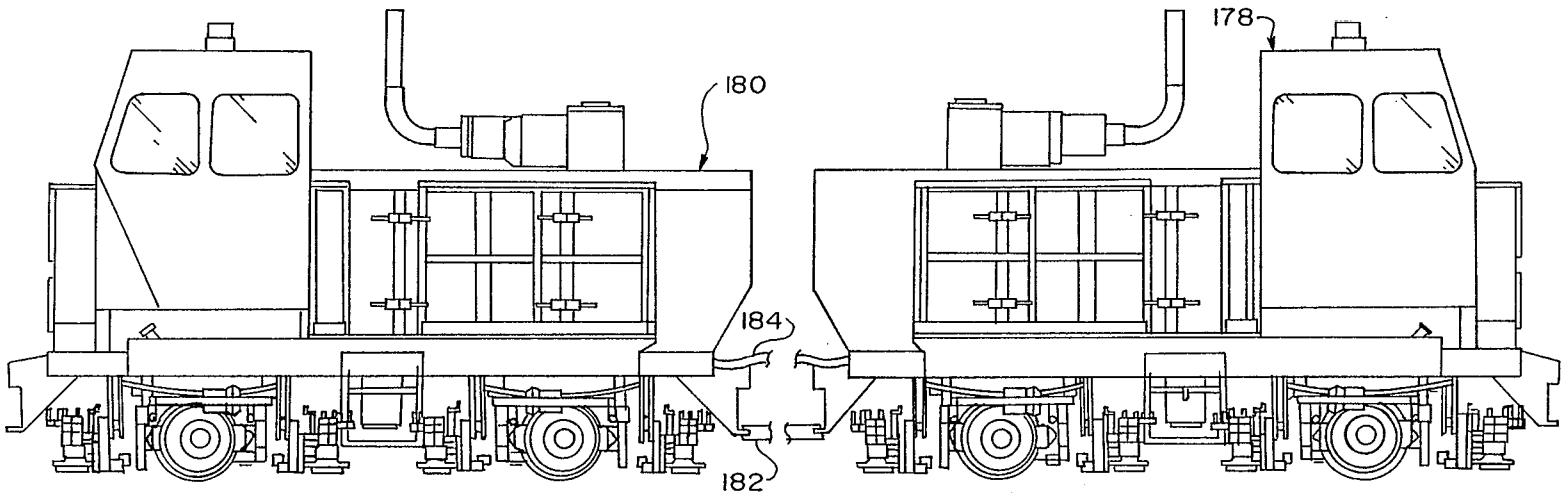
FIG. 16 shows two of the vehicles of the present invention coupled together for master-slave operation.

The illustrated remote in and out lines of the control cards are useful for operating two of two of the rail control vehicles 10 in tandem. With reference to FIG. 16, a first vehicle 178 may be used to control a second vehicle 180 which may be coupled thereto by a mechanical hitch 182 and electrical wires 184.

The control wires 184 would include the various remote inputs and outputs illustrated in FIGS. 12A, 12B, 13A, and 13B such that an operator in the cab of master vehicle 178 may operate the various grinders of the vehicle 180. A specific example maybe useful to illustrate this arrangement for operation. The remote power control in terminal of FIG. 13A will be supplied to the amplifier 158 when the particular control card is operating as a "slave" card. This "master power control in signal" may be scaled by amplifier 186 and fed as a remote power control out signal which may have an additional control card operated therefrom. By use of the illustrated remote in and remote out lines, control cards in first vehicle 178 may serve as master circuits to cards in vehicle 180 which serve as slave cards.

Figure 14:
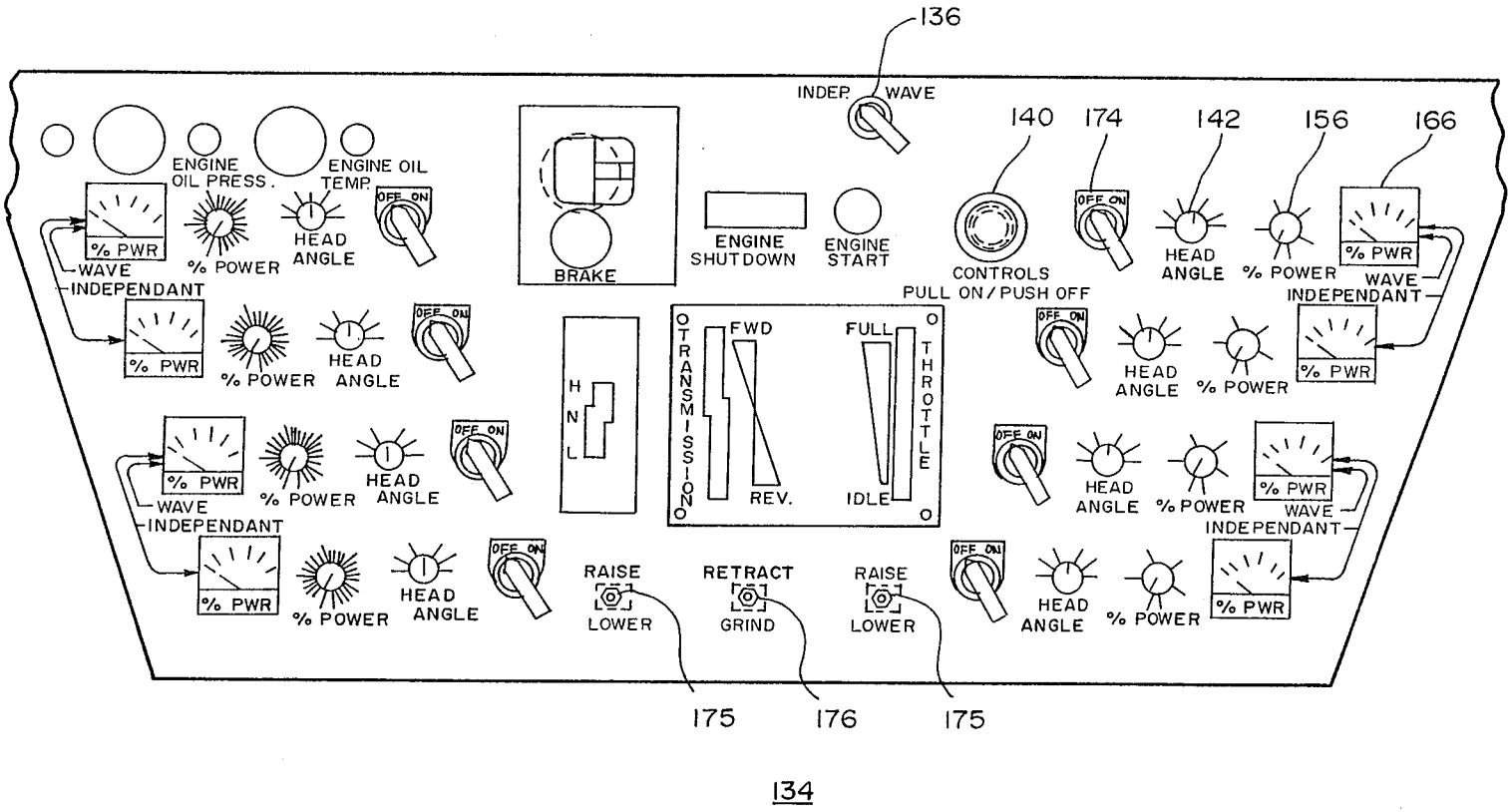
FIG. 14 shows a control console used with the present invention.

Various electrical circuit arrangements could be used for operating the numerous valve solenoids from the console control panel shown in FIG. 14 and these need not be shown in detail. For example, the raise/lower toggle switches will energize solenoids corresponding to valves 118W2 and 118R1 when in the independent mode, but will energize the solenoids corresponding to valves 118R2 and 118W1 when in the wave control mode and a simple relay or gating circuit may be used to accomplish this switching function dependent upon the position of the independent/wave or mode controller switch 136. In similiar fashion, various of the switches shown on the control console may operate solenoids corresponding to the valves and, as the specifics of such relatively simple circuits used to operate the solenoids are not central to the present invention, further elaboration is unnecessary.

The operation of the present invention will be readily understood from the foregoing description. The invention provides a system whereby grinders can be operated independently or in unison at a common vertical level. Although the preferred embodiment shows two grinders being coupled together by operation of the present hydraulic system, this highly advantageous feature can be used to couple together more than two hydraulic cylinders if desired. By having the grinders supported from the chassis frame by way of the K frame 28 pivotably mounted to the chassis about a central pivot axis 30 (FIG. 5) the grinders have less of a tendency to follow waves in the rail. For example, if a rail has a wave with a $\frac{1}{4}$ inch peak, the vehicle wheel rolling over that peak will have its height raised by $\frac{1}{4}$ inch. However, the central pivot axis 30 will move upwardly only a fraction of $\frac{1}{4}$ inch. Thus, the grinder may be relatively close in a longitudinal directional to the wheel such that it generally tracks the rail for transverse changes to minimize the chordal errors without the need for separate rollers or feelers, but will be resistant to following the waves in the rail.

Although various specific constructions have been illustrated herein, numerous modifications and adaptations will be readily apparent to those of skill in the art. Accordingly, it is to be understood that the descriptions are for illustrative purposes only. The scope of the present invention should be determined by reference by the claims.

What is claimed is:

1. A rail grinder vehicle having a front, back, and two opposite sides and comprising:

(a) a chassis having wheels for movement along a railroad track;

(b) a grinder assembly mounting frame movably mounted to said chassis;

(c) first and second grinder support members mounted to said grinder assembly mounting frame;

(d) first and second grinders respectively mounted to said first and second grinder support members, each grinder having a grind stone, a motor for rotating the grind stone, and a feed jack operable for moving the grind stone against and away from a rail, and both grinders mounted to allow grinding a common rail on one side of the vehicle;

(e) a control jack attached to said chassis and operable to move said grinder assembly mounting frame relative to said chassis and, in turn, to move said first and second grinders;

(f) a control system for controlling the position of the grind stones relative to a rail; and (g) a mode controller connected to said control system, and operable for grinding in an independent mode to apply the grind stones against a rail by causing said control system to separately control the feed jacks of said first and second grinders, and operable for grinding in a wave mode to apply the grind stones against a rail by causing said control system to control the wave control jack while maintaining the feed jacks in a steady state, said wave mode having said grind stones linked for movement in unison to smooth out waves in rail.

2. The rail grinder vehicle wherein said control system is operable for grinding in said independent mode by maintaining said control jack in a steady state, and wherein said control system sets said feed jacks at a common stroke length when grinding in said wave mode.

3. The rail grinder vehicle of claim 1 wherein said control system includes an hydraulic system, and wherein said feed jacks and said control jack are hydraulic, and wherein said hydraulic system includes two grind feed lines and a mode valve means, and wherein, in said independent mode, said mode controller causes said mode valve means to allow application of hydraulic fluid to at least one of said feed jacks, and, in said wave control mode, said mode controller causes said mode valve means to allow application of hydraulic fluid to said wave control jack.

4. The rail grinder vehicle of claim 1 wherein said control system is operable for grinding in said independent mode to maintain each motor of said grinder at a constant power.

5. The rail grinder vehicle of claim 4 wherein said control system is operable for grinding in said wave mode to insure that, at any given time, at least one motor of said grinders is at a predetermined power.

6. The rail grinder vehicle of claim 4 wherein said control system is operable when grinding in said wave mode to control said control jack such that:

the sum of the power of the motors of said grinders automatically varies over time depending on surface variations of the rail which is being ground; the power of each motor of said grinders automatically varies over time depending on surface variations of the rail which is being ground; and at any given time, at least one motor of said grinders is at a predetermined power and an other motor of said grinders is at no greater than said predetermined power.

7. The rail grinder vehicle of claim 1 wherein said control system further includes an electrical system, said electrical system controlling said wave control jack and said feed jacks, and wherein said electrical system includes a first feedback loop operable during grinding in said independent mode to maintain said motor of said first grinder at a constant power, and wherein said first feedback loop is operable during grinding in said wave mode to control said control jack such that:

the sum of the power of the motors of said grinders automatically varies over time depending on surface variations of the rail which is being ground; the power of each motor of said grinders automatically varies over time depending on surface variations of the rail which is being ground; and at any given time, at least one motor of said grinders is at a predetermined power and an other motor of said grinders is at no greater than said predetermined power.

8. The rail grinder vehicle of claim 1 furtner comprising first and second grind stone positioners, each positioner operable to simultaneously change the position and angle of a corresponding one of said grind stones relative to a rail such that, for any given angle over a range of angles, said one of said grind stones is in proper position for said feed jack to apply the grind stone against 1.

9. The rail grinder vehicle of claim 1 wherein said grinder assembly mounting frame is pivotably attached to said chassis by a pivot axis extending longitudinally along said rail grinder vehicle, said pivot axis being spaced from a side adjacent to said grind stones by at least 40% of the distance to a side remote from said grind stones, and wherein said first and second grinder support members are separately, movably mounted to said grinder assembly mounting frame.

10. The rail grinder vehicle of claim 1 further comprising a first transducer outputting an electrical torque signal as a function of the torque of said motor of said first grinder, and said control system receives said torque signal and is operable during grinding in said independent mode to control said feed jack of said first grinder for moving said grind stone of said first grinder to maintain said motor of said first grinder at a constant power.

11. A rail grinder vehicle having a front, back, and two opposite sides and comprising:

(a) a chassis having wheels for movement along a railroad track;

(b) a grinder assembly mounting frame movably mounted to said chassis and including a beam extending lengthwise along said vehicle;

(c) first and second grinder support members separately and pivotably mounted to said grinder assembly mounting frame;

(d) first and second grinders respectively mounted to said first and second grinder support members, each grinder having a grind stone, a motor for rotating the grind stone, and a feed jack operable for moving the grind stone against and away from a rail, and both grinders operable for grinding on a rail common thereto and upon which an adjacent pair of said wheels are supported;

(e) a control system for controlling the position of the grind stones relative to a rail; and wherein said grinder assembly mounting frame is pivotably attached to said chassis by a pivot axis extending longitudinally along said rail grinder vehicle, said pivot axis being transversely spaced from one of said sides of said vehicle adjacent to said grind stones by at least 40% of the distance to the other of said sides of said vehicle remote from said grind stones, and wherein said pivot axis is fixed relative to said chassis.

12. The rail grinder vehicle of claim 11 wherein said pivot axis extends centrally along said vehicle.

13. The rail grinder vehicle of claim 12 further comprising a control jack attached to extend between said chassis and said beam and operable to vertically move said grinder assembly mounting frame relative to chassis.

14. The rail grinder vehicle of claim 13 further comprising first and second links separately, pivotably connected in a common axis to said chassis above and vertically in line with said pivot axis for movement in parallel to said grinder assembly mounting frame, said first and second links maintaining said first and second grinder support members in the same orientation independent of said control jack.

15. The rail grinder vehicle of claim 3 further comprising first and second grind stone positioners, each positioner operable to simultaneously change the position and angle of a corresponding one of said grind stones relative to a rail such that, for any given angle over a range of angles, said corresponding one of said grind stones is in proper position for said feed jack to apply the grind stone against the rail.

16. The rail grinder vehicle of claim 15 further comprising first and second pivot members, each pivot member pivotably attached to a corresponding one of said first and second grinder support members and pivotably attached to a corresponding one of said first and second positioners, and wherein each of said first and second grinders is mounted to a corresponding one of said first and second grinder support members by way of a corresponding one of said first and second pivot members.

17. The rail grinder vehicle of claim 14 wherein said feed jacks and control jacks are hydraulic jacks, and said control system includes a hydraulic system, and further comprising a mode controller connected to said hydraulic system and operable in an independent mode to apply the grind stones against a rail by causing said hydraulic system to separately control the feed jacks of said first and second grinders, and operable in a wave mode to apply the grind stones against a rail by causing said hydraulic system to control the control jack while maintaining the feed jacks in a steady state, said wave mode linking said grind stones together for movement in unison to smooth out waves in a rail.

18. The rail grinder vehicle of claim 17 wnerein said control system is operable when grinding in said independent mode to maintain each of said motors at a constant power and is operable when grinding in said wave mode to control said control jack such that:

the sum of the power of the motors of said grinders automatically varies over time depending on surface variations of the rail which is being ground; the power of each motor of said grinders automatically varies over time depending on surface variations of the rail which is being ground; and at any given time, at least one motor of said grinders is at a predetermined power and an other motor of said grinders is at no greater than said predetermined power.

19. The rail grinder vehicle of claim 11 further comprising a first transducer outputting an electrical torque signal as a function of the torque of said motor of said first grinder, and a control system receiving said torque signal and operable to control said feed jack of said first grinder for moving said grind stone of said first grinder, said control system operable to maintain said motor of said first grinder at a constant power.

20. The rail grinder vehicle of claim 11 wherein said beam extends to opposite sides of one of said wheels and each of said first and second grinder support members is mounted on opposite sides of said one of said wheels.

21. A rail grinder vehicle having a front, back, and two opposite sides and comprising:

(a) a chassis having wheels for movement along a railroad track;

(b) a firs grinder supported by said chassis, said first grinder having a grind stone, a motor for rotoring the grind stone, and a feed jack operable for moving the grind stone against and away from a rail; and (c) a first grind stone positioner operable for changing the angle of said grind stone relative to a rail over a range of angles and operable to simultaneously change the position and angle of said grind stone relative to said rail such that, upon said positioner moving said grind stone from any one nagle to any other angle, operation of said positioner is sufficient to maintain said grind stone at a proper position to allow said feed jack to apply said grind stone against the rail, and further comprising a first grinder support member supported by said chassis and having the first grinder mounted thereto, and a first pivot member pivotably attached at an upper pivot point to said first grinder support member, said first positioner operable to pivot said first pivot member, and wherein said first grinder is mounted to said first grinder support member by way of said first pivot member, and further comprising a first arm pivotably mounted to said first pivot member at a lower pivot point spaced from said upper pivot point and wherein said first grinder is mounted to said first arm.

22. The rail grinder vehicle of claim 21 wherein said first positionioner is operable to change the position of said grind stone both horizontally and vertically.

23. The rail grinder vehicle of claim 22 wherein said first positioner is controlled by an angle controller mounted in a cab on said vehicle.

24. The rail grinder vehicle of claim 22 wherein said first positioner allows the angle of said grind stone relative to the rail to vary over a range of at least 180°, and wherein said first positioner allows the angle of said first grind stone relative to the rail to be set at any angle within said range.

25. The rail grinder vehicle of claim 22 wherein said first positioner is operable, when said feed jack is retracted, to maintain the distance from said grind stone to the rail uniform over said range within +20% of a given value.

26. The rail grinder vehicle of claim 25 further comprising an orientation means to automatically pivot said first arm and said first grinder about said lower pivot point when said first positioner pivots said first pivot member.

27. The rail grinder vehicle of claim 26 further comprising a shaft mounted at said lower pivot point and a sprocket mounted to said shaft, and wherein said shaft is fixed to said first arm and said orientation means is a chain meshed to said sprocket and attached to said first grinder support member.

28. The rail grinder vehicle of claim 27 further comprising a brake operable to secure said first arm in a given position.

29. The rail grinder vehicle of claim 28 further comprising a grinder assembly frame movably mounted to said chassis, a first grinder support member mounted to said grinder assembly frame and having said first grinder mounted thereon, a second grinder support member mounted to said grinder assembly frame, and a second grinder and second grind stone positioner constructed and operable in like fashion respectively to said first grinder and said first grind stone positioner, and both of said grinder support members are pivotably mounted to said grinder assembly mounting frame, and wherein said grinder assembly mounting frame is pivotably attached to said chassis by a pivot axis extending longitudinally along said rail grinder vehicle, said pivot axis being transversely spaced from a side adjacent to said grinders by at least 40% of the distance to a remote side.

30. The rail grinder vehicle of claim 29 further comprising a control jack attached to said chassis and operable to vertically move said grinder assembly mounting frame, relative to chassis.

31. The rail grinder vehicle of claim 22 further comprising a rail cant adjustment mechanism for changing the angle of said grind stone without changing the position of said grind stone such that said first positioner may change the angle and position of said grind stone for a canted rail.

32. A rail grinder vehicle having a front, a back, and two opposite sides, and comprising:

(a) a chassis having wheels for movement along a railroad track;

(b) a first grinder support member supported by said chassis;

(c) a first grinder mounted to said first grinder support member, said first grinder having a first grind stone, a first motor for rotating the grind stone, a first feed jack operable for moving the first grind stone against and away from a rail;

(d) a first transducer outputting an electrical torque signal as a function of the torque of said first motor; and (e) a control system receiving said torque signal and operable to control said first feed jack for moving said first grind stone, said control system further operable to maintain said first motor at a constant power; and wherein said first motor is hydraulic, said first transducer senses the input pressure to said first motor, and said control system includes an electrical comparison means to compare an electrical signal derived from said first transducer with a setpoint electrical signal and output a control signal, and said control system further comprises a pressure control pilot valve controlling the flow of fluid into two chambers of said feed jack dependent upon said control signal and wherein said first feed jack is hydraulic and has a stroke direction which is always parallel to an axis of rotation of said first motor, and wherein said first grind stone is the only grind stone which is movable by operation of said first feed jack and wherein said pressure control pilot valve has a closed loop pressure control with hydraulic pressure internal to the pressure control pilot valve providing intrinsic feedback.

33. A rail grinder vehicle having a front, a back, and two opposite sides, and comprising:

(a) a chassis having wheels for movement along a railroad track;

(b) a first grinder support member supported by said chassis;

(c) a first grinder mounted to said first grinder support member, said first grinder having a first grind stone, a first motor for rotating the grind stone, a first feed jack operable for moving the first grind stone against and away from a rail;

(d) a first transducer outputting an electrical torque signal as a function of the torque of said first motor; and (e) a control system receiving said torque signal and operable to control said first feed jack for moving said first grind stone, said control system further operable to maintain said first motor at constant power; and wherein said first motor is hydraulic, said first transducer senses the input pressure to said first motor, and said control system includes a comparison means to compare a signal derived from said first transducer with a set point signal and output a control signal, and said control system further comprises a pressure control pilot valve controlling the flow of fluid into two chambers of said feed jack dependent upon said control signal; and a second grinder support member and second grinder constructed and operable in like fashion respectively as said first grinder support member and said first grinder, as grinder assembly frame movably mounted to said chassis, and a wave control jack attached to said chassis and operable to move said grinder assembly mounting frame relative to said chassis and, in turn, to move said first and second grinders, and wherein both said grinder support members are mounted to said grinder assembly mounting frame; and further comprising a mode controller connected to said control system and operable in an independent mode to apply the grind stones against a rail by causing said control system to separately control the feed jacks of said first and second grinders, and operable in a wave mode to apply the grind stones against a rail by causing said control system to control the wave control jack while maintaining the feed jacks in a steady state, sadi wave mode linking said grind stones together for movement in unison to smooth out waves in a rail.

34. The rail grinder vehicle f claim 33 wherein said control system is operable when grinding in said independent mode to maintain each of said motors at a constant power.

35. The rail grinder vehicle of claim 34 wherein said control system is operable when grinding in said wave mode to control said control jack such that:

the sum of the power of the motors of said grinders automatically varies over time depending on surface variations of the rail which is belng ground; the power of each motor of said grinders automatically varies over time depending on surface variations of the rail which is being ground; and at any given time, at least one motor of said grinders is at a predetermined power and another motor of said grinders is at no greater than said predetermined power.

36. The rail grinder vehicle of claim 33 wherein said control system further includes an electrical system, said electrical system controlling said wave control jack and said feed jacks and including a first feedback loop operable during grinding in said independent mode to maintain said first motor at a constant power, and wherein said first feedback loop is operable when grinding in said wave mode to control said control jack such that:

the sum of the power of the motors of said grinders automatically varies over time depending on surface variations of the rail which is being ground; the power of each motor of said grinder automatically varies over time depending on surface variations of the rail which is being ground; and at any given time, at least one motor of said grinders is at a predetermined power and an other motor of said grinders is at no greater than said predetermined power.

37. The rail grinder vehicle of claim 36 wherein said grinder assembly mounting frame is pivotably attached to said chassis by a pivot axis extending longitudinally along said rail grinder vehicle, said pivot axis being spaced from said grind stones by at least 40% of the distance from a side adjacent to said grinders to a remote side, and further comprising first and second grind stone positioners, each positioner operable to simultaneously change the position and angle of a corresponding one of said grind stones relative to a rail such that, for any given angle over a range of angles, said one of said grind stones is in proper position for said feed jack to apply the grind stone against the rail.

38. A rail grinder vehicle comprising:

(a) a chassis having a wheels for movement along a railroad track;

(b) a first grinder supported by said chassis, said first grinder having a grind stone, a motor for rotation the grind stone, and a feed jack operable for moving the grind stone against and away from a rail; and (c) a pivot member supported by said chassis at an upper pivot point; and wherein said grinder is pivotably supported by said pivot member at a lower pivot point spaced from said upper pivot point, and further comprising an arm pivotably mounted to said pivot member at said lower pivot point, and said grinder is mounted to said arm, and further comprising a positioner operable to pivot said pivot member about said upper pivot point and to cause said arm to pivot about said lower pivot point.

39. The rail grinder vehicle of claim 38 further comprising a rail cant adjustment mechanism for changing the angle of said grind stone without changing the position of said grind stone such that said first postioner may change the angle and position of said grind stone for a conted rail

40. The rail grinder vehicle of claim 38 wherein said positioner is operable to change the angle of said grind stone relative to a rail over 120° and said positioner is controlled by an angle controller mounted in a cab on said vehicle.

41. The rail grinder vehicle of claim 38 further comprising an orientation chain which automatically pivots said arm and said grinder about said lower pivot point when when said positioner pivots said pivot member about said upper pivot point.

42. A rail grinder vehicle comprising:

(a) a chassis having wheels for movement along a railroad track;

(b) a grinder assembly mounting frame movably mounted to said chassis;

(c) a plurality of grinders supported by said grinders assembly mounting frame, each grinder having a grind stone and a motor for rotating the grind stone and mounted to allow grinding on a common rail on one side of the vehicle;

(c) a control jack attached to said chassis and operable to move said grinder assembly mounting frame relative to said chassis and, in turn, to move said grinders against and away from a rail;

(d) a plurality of transducers, each transducer generating an output depending on an associated one motor of said grinders; and (e) a control system receiving the outputs of said transducers and having a feedback loop operable for controlling said control jack based upon a selected one of said outputs, the control system over time automatically varying which one of the outputs is selected as an input to said feedback loop.

43. The rail grinder vehicle of claim 42 wherein each of said outputs is dependent on the torque of one of said motors.

* * * * *

UNITED STATES PATENT AND TRADEMARK OFFICE

CERTIFICATE OF CORRECTION

PATENT NO. : 4,779,384

DATED : October 25, 1988

INVENTOR(S) : SHOENHAIR et al.

It is certified that error appears in the above-identified patent and that said Letters Patent is hereby corrected as shown below:

Claim 1, column 22, line 56, after "in" insert --a--.

Claim 2, column 22, line 57, after "vehicle" insert --of claim 1--;

Claim 8, column 23, line 53, after "against" insert --the rail-- and delete "l";

Claim 15, column 24, line 47, change "3" to --13--;

Claim 21, column 25, line 42, change "firs" to --first--.

Claim 21, column 25, line 43, change "rotoring" to --rotating--;

Claim 21, column 25, line 52, change "nagle" to --angle--.

Signed and Sealed this

Eighteenth Day of April, 1989

*Attest:*

DONALD J. QUIGG

*Attesting Officer*

*Commissioner of Patents and Trademarks*